US011013388B2

(12) United States Patent
Jang et al.

(10) Patent No.: US 11,013,388 B2
(45) Date of Patent: May 25, 2021

(54) ROBOT CLEANER

(71) Applicant: LG ELECTRONICS INC., Seoul (KR)

(72) Inventors: Jaewon Jang, Seoul (KR); Sungho Yoon, Seoul (KR); Minwoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 143 days.

(21) Appl. No.: 16/057,550

(22) Filed: Aug. 7, 2018

(65) Prior Publication Data

US 2019/0038104 A1 Feb. 7, 2019

(30) Foreign Application Priority Data

Aug. 7, 2017 (KR) ..... 10-2017-0099763

(51) Int. Cl.

*A47L 11/282* (2006.01)
*A47L 11/40* (2006.01)
*A47L 9/30* (2006.01)

(52) U.S. Cl.

CPC ..... *A47L 11/4008* (2013.01); *A47L 9/30* (2013.01); *A47L 11/282* (2013.01); *A47L 11/4019* (2013.01); *A47L 11/4083* (2013.01); *A47L 11/4088* (2013.01); *A47L 2201/00* (2013.01); *A47L 2201/026* (2013.01)

(58) Field of Classification Search

CPC ..... A47L 11/282; A47L 11/4008; A47L 11/4019; A47L 11/4083; A47L 11/4088; A47L 2201/00; A47L 2201/026

See application file for complete search history.

(56) References Cited

U.S. PATENT DOCUMENTS

| | | | |
|---|---|---|---|
| 2,988,762 | A | 6/1961 | Babcock |
| 5,421,053 | A | 6/1995 | Chodak |
| 5,998,953 | A | 12/1999 | Nakamura et al. |
| 6,012,618 | A | 1/2000 | Matsuo |
| 8,898,844 | B1 | 12/2014 | Dooley et al. |
| 2004/0143927 | A1 | 7/2004 | Haegermarck et al. |
| 2004/0181896 | A1 | 9/2004 | Egawa et al. |

(Continued)

FOREIGN PATENT DOCUMENTS

| | | |
|---|---|---|
| CN | 1320409 | 11/2001 |
| CN | 1575724 | 2/2005 |

(Continued)

OTHER PUBLICATIONS

European Search Report dated Nov. 16, 2018 issued in EP Application No. 18187634.3.

(Continued)

*Primary Examiner* — Randall E Chin
(74) *Attorney, Agent, or Firm* — KED & Associates, LLP

(57) ABSTRACT

A cleaner includes a body defining an exterior appearance of the robot cleaner; a cleaning module coupled to the body and capable of performing cleaning with water. The cleaner also includes a water tank capable of being withdrawn from the body, and storing water to be supplied to the cleaning module. The cleaner also includes a light source inside the body, and positioned to allow emitted light to pass through the water tank and then discharged outside of the body.

20 Claims, 17 Drawing Sheets

(56) References Cited

U.S. PATENT DOCUMENTS

| | | | |
|---|---|---|---|
| 2005/0015913 | A1 | 1/2005 | Kim et al. |
| 2005/0166356 | A1 | 8/2005 | Uehigashi |
| 2006/0185690 | A1 | 8/2006 | Song et al. |
| 2007/0051757 | A1 | 3/2007 | Lim et al. |
| 2007/0061040 | A1 | 3/2007 | Augenbraun et al. |
| 2008/0276407 | A1 | 11/2008 | Schnittman et al. |
| 2011/0202175 | A1 | 8/2011 | Romanov et al. |
| 2012/0168971 | A1* | 7/2012 | Hansen ..... A47L 11/4086 261/30 |
| 2012/0169497 | A1 | 7/2012 | Schnittman et al. |
| 2012/0222706 | A1* | 9/2012 | Pears ..... F22B 1/285 134/18 |
| 2014/0196247 | A1 | 7/2014 | Kasper |
| 2014/0259478 | A1 | 9/2014 | Conrad |
| 2015/0182090 | A1 | 7/2015 | Park et al. |
| 2015/0223653 | A1 | 8/2015 | Kim et al. |
| 2016/0214260 | A1 | 7/2016 | Lee et al. |
| 2016/0353960 | A1 | 12/2016 | Dooley et al. |
| 2017/0143175 | A1 | 5/2017 | Kim et al. |
| 2017/0147000 | A1 | 5/2017 | Hoennige et al. |
| 2017/0181591 | A1 | 6/2017 | Tanaka et al. |
| 2017/0296021 | A1 | 10/2017 | Li et al. |
| 2018/0242810 | A1 | 8/2018 | Jang et al. |
| 2019/0290089 | A1 | 9/2019 | Johnson et al. |

FOREIGN PATENT DOCUMENTS

| | | |
|---|---|---|
| CN | 1823677 | 8/2006 |
| CN | 204581160 | 8/2015 |
| CN | 104918529 | 9/2015 |
| CN | 106510556 | 3/2017 |
| CN | 106725135 | 5/2017 |
| EP | 1 762 165 | 3/2007 |
| EP | 3 138 459 | 3/2017 |
| JP | S49-65061 | 6/1974 |
| JP | S57-037431 | 3/1982 |
| JP | S63-168142 | 7/1988 |
| JP | H09-324875 | 12/1997 |
| JP | H10-211132 | 8/1998 |
| JP | 2003-320322 | 11/2003 |
| JP | 2004-166968 | 6/2004 |
| JP | 2005-040578 | 2/2005 |
| JP | 2005-211368 | 8/2005 |
| JP | 2005-211426 | 8/2005 |
| JP | 2006-231028 | 9/2006 |
| JP | 2009-509220 | 3/2009 |
| JP | 2009-178345 | 8/2009 |
| JP | 2014-014455 | 1/2014 |
| JP | 2014-137694 | 7/2014 |
| JP | 2015-163153 | 9/2015 |
| KR | 20-1988-0011603 | 8/1988 |
| KR | 10-0241620 | 4/2000 |
| KR | 10-2005-0012047 | 1/2005 |
| KR | 20-0395016 | 9/2005 |
| KR | 10-0661339 | 12/2006 |
| KR | 20-0437646 | 12/2007 |
| KR | 10-0814507 | 3/2008 |
| KR | 10-2008-0040761 | 5/2008 |
| KR | 10-0835968 | 6/2008 |
| KR | 10-0848568 | 7/2008 |
| KR | 10-2008-0081626 | 9/2008 |
| KR | 10-0871114 | 11/2008 |
| KR | 10-2010-0076134 | 7/2010 |
| KR | 10-1026003 | 3/2011 |
| KR | 20-0458863 | 3/2012 |
| KR | 10-2012-0069845 | 6/2012 |
| KR | 10-1152720 | 6/2012 |
| KR | 10-1164291 | 7/2012 |
| KR | 10-2012-0129185 | 11/2012 |
| KR | 10-1323597 | 11/2013 |
| KR | 10-1338143 | 12/2013 |
| KR | 10-2014-0011216 | 1/2014 |
| KR | 10-1369220 | 3/2014 |
| KR | 10-2014-0060450 | 5/2014 |
| KR | 10-1487778 | 1/2015 |
| KR | 10-2015-0014351 | 2/2015 |
| KR | 10-1495866 | 2/2015 |
| KR | 10-2015-0057959 | 5/2015 |
| KR | 10-1519685 | 5/2015 |
| KR | 10-2015-0073726 | 7/2015 |
| KR | 10-2015-0078094 | 7/2015 |
| KR | 10-2015-0095469 | 8/2015 |
| KR | 10-1543490 | 8/2015 |
| KR | 10-1544667 | 8/2015 |
| KR | 10-2015-0107398 | 9/2015 |
| KR | 10-2015-0139111 | 12/2015 |
| KR | 10-1578879 | 12/2015 |
| KR | 10-1602790 | 3/2016 |
| KR | 10-1622740 | 5/2016 |
| KR | 10-2016-0090567 | 8/2016 |
| KR | 10-2016-0090571 | 8/2016 |
| KR | 10-2016-0097085 | 8/2016 |
| KR | 10-1654014 | 9/2016 |
| KR | 10-1678443 | 12/2016 |
| KR | 10-2017-0049532 | 5/2017 |
| KR | 10-2017-0124216 | 11/2017 |
| KR | 10-2018-0008250 | 1/2018 |
| WO | WO 2015/186944 | 12/2015 |

OTHER PUBLICATIONS

Korean Office Action dated Jan. 22, 2019 issued in KR Application No. 10-2017-0099763.

United States Office Action dated Apr. 24, 2020 issued in U.S. Appl. No. 16/057,492.

Korean Office Action dated Nov. 20, 2018 issued in KR Application No. 10-2017-0099754.

Korean Office Action dated Nov. 21, 2018 issued in KR Application No. 10-2017-0099755.

Korean Office Action dated Nov. 21, 2018 issued in KR Application No. 10-2017-0099756.

Korean Office Action dated Nov. 21, 2018 issued in KR Application No. 10-2017-0099757.

International Search Report dated Dec. 4, 2018 issued in PCT/KR2018/008928.

International Search Report dated Dec. 7, 2018 issued in PCT/KR2018/008922.

International Search Report dated Dec. 10, 2018 issued in PCT/KR2018/008954 (English translation).

United States Notice of Allowance dated May 11, 2020 issued in U.S. Appl. No. 16/057,572.

Korean Office Action dated Oct. 29, 2019 issued in KR Application No. 10-2019-0124685.

Korean Office Action dated Nov. 29, 2018 issued in KR Application No. 10-2017-0099758.

International Search Report dated May 22, 2019 issued in PCT/KR2019/001021.

Korean Notice of Allowance dated May 22, 2019 issued in KR Application No. 10-2017-0099753.

Korean Office Action dated Jan. 31, 2019 issued in Application No. 10-2018-0009437.

European Search Report dated Nov. 14, 2018 issued in EP Application No. 18187619.4.

European Search Report dated Nov. 14, 2018 issued in EP Application No. 18187630.1.

Korean Office Action dated Nov. 20, 2018 issued in KR Application No. 10-2017-0099752.

U.S. Appl. No. 16/057,394, filed Aug. 7, 2018.

U.S. Appl. No. 16/057,492, filed Aug. 7, 2018.

U.S. Appl. No. 16/056,971, filed Aug. 7, 2018.

U.S. Appl. No. 16/057,572, filed Aug. 7, 2018.

United States Office Action dated Oct. 21, 2020 issued in U.S. Appl. No. 16/057,076.

Korean Office Action dated Apr. 22, 2020 issued in KR Application No. 10-2019-0124685.

United States Office Action dated Nov. 19, 2020 issued in U.S. Appl. No. 16/057,448.

(56) References Cited

OTHER PUBLICATIONS

United States Office Action dated Feb. 9, 2021 issued in U.S. Appl. No. 16/057,516.
Chinese Office Action (with English translation) dated Dec. 28, 2020 issued in CN Application No. 201880065371.4.
Chinese Office Action (with English translation) dated Dec. 21, 2020 issued in CN Application No. 201880065247.8.
Japanese Office Action dated Feb. 2, 2021 issued in JP Application No. 2020-506999.
U.S. Appl. No. 16/057,448, filed Aug. 7, 2018.
U.S. Appl. No. 17/207,371, filed Mar. 19, 2021.
U.S. Appl. No. 16/256,435, filed Jan. 24, 2019.
U.S. Appl. No. 16/057,516, filed Aug. 7, 2018.
U.S. Appl. No. 16/057,076, filed Aug. 7, 2018.
U.S. Appl. No. 17/180,495, filed Feb. 19, 2021.
U.S. Appl. No. 16/057,550, filed Aug. 7, 2018.
Japanese Office Action dated Mar. 2, 2021 issued in JP Application No. 2020-506998.

* cited by examiner

ROBOT CLEANER

CROSS-REFERENCE TO RELATED APPLICATION(S)

This application claims the priority benefit of Korean Patent Application No. 10-2017-0099763, filed on Aug. 7, 2017 in the Korean Intellectual Property Office, the disclosure of which is incorporated herein by reference.

BACKGROUND

1. Field

The present disclosure relates to a robot cleaner and, more particularly, to a robot cleaner which performs cleaning with water.

2. Background

Cleaning a floor through mopping may be labor intensive. For example, to clean a floor, the user typically moves a moping device forward and backward repeatedly by applying a certain amount of force. Thus, mopping may be burdensome to the user and may be an inefficient cleaning process.

Cleaners to automatically mop a floor have been developed. Additionally, robot cleaners capable of autonomously mopping a floor are being developed. A robot cleaner that includes a cleaning module for mopping may include a water tank that stores water and a flow path that supplies water from the tank and to the cleaning module. Certain moping robot cleaners may have a water tank which can be decoupled from the robot cleaner to add water. However, residual water may remain in the water tank. In addition, a user may not unable to determine an amount of water in the water tank.

BRIEF DESCRIPTION OF THE DRAWINGS

The embodiments will be described in detail with reference to the following drawings in which like reference numerals refer to like elements wherein.

DETAILED DESCRIPTION

Figure 1:
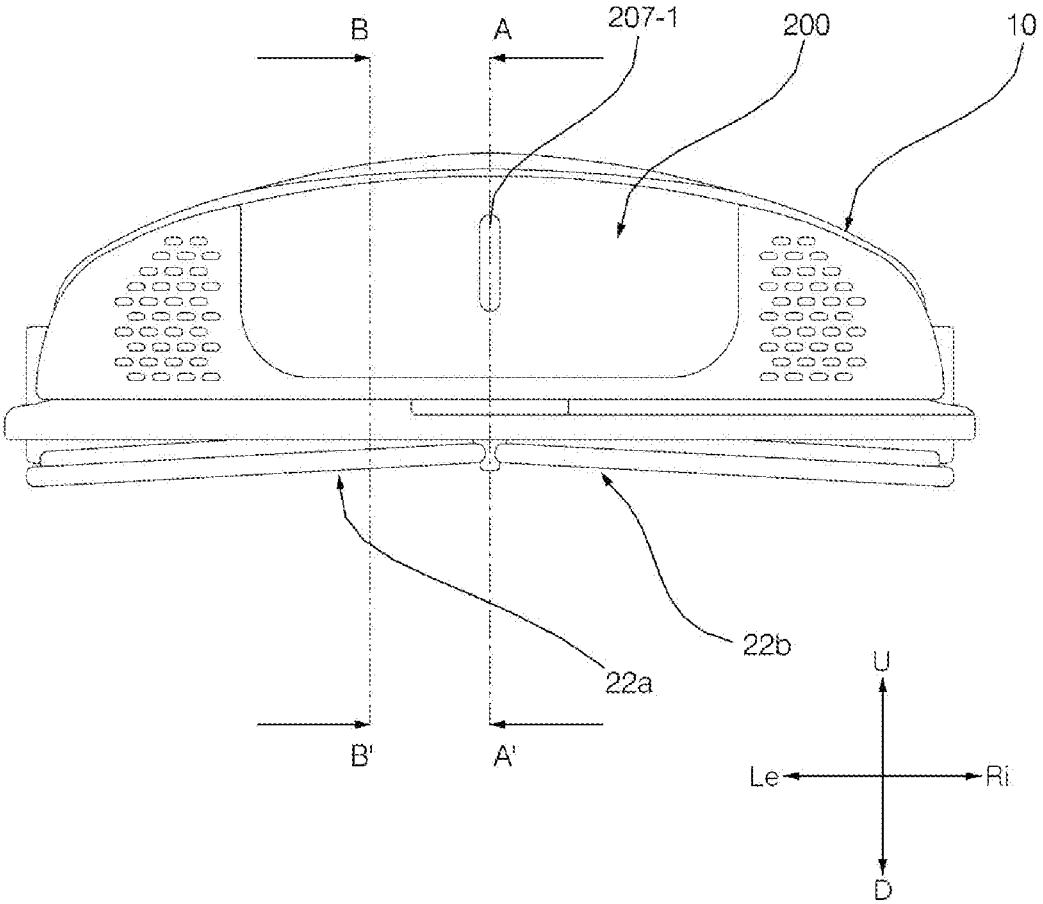
FIG. 1 is a rear perspective view of a robot cleaner according to an embodiment of the present disclosure.

The aspects of the present disclosure will become apparent from the detailed description of the following embodiments in conjunction with the accompanying drawings. It should be understood that the present disclosure is not limited to the following embodiments and may be embodied in different ways, and that the embodiments are given to provide complete disclosure of the disclosure and thorough understanding of the present disclosure to those skilled in the art. The scope of the present disclosure is defined only by the claims. Like reference numerals indicate like elements throughout the specification and drawings.

The terms "forward (F)", "rearward (R)", "leftward (Le)", "rightward (Ri)", "upward (U)", and "downward (D)" mentioned in the following description are defined as shown in the drawings. However, the terms are used merely to clearly understand the present disclosure, and therefore the above-mentioned directions may be differently defined.

Hereinafter, a robot cleaner 1 according to embodiments of the present disclosure will be described with reference to the accompanying drawings. The robot cleaner 1 may include a body 10 defining the exterior appearance of the robot cleaner 1. The robot cleaner 1 may include a cleaning module (or cleaning head) 21, 22 which is coupled to the body 10 and which performs cleaning with water. The robot cleaner 1 may include a water tank 200 which is able to be withdrawn from the body 10, and which stores water to be supplied to the cleaning module 21, 22. The robot cleaner 1 may include a light source 160 which is positioned inside the body 10 and preset to allow emitted light to pass through the water tank 200 and be then emitted outside the body 10.

Figure 2:
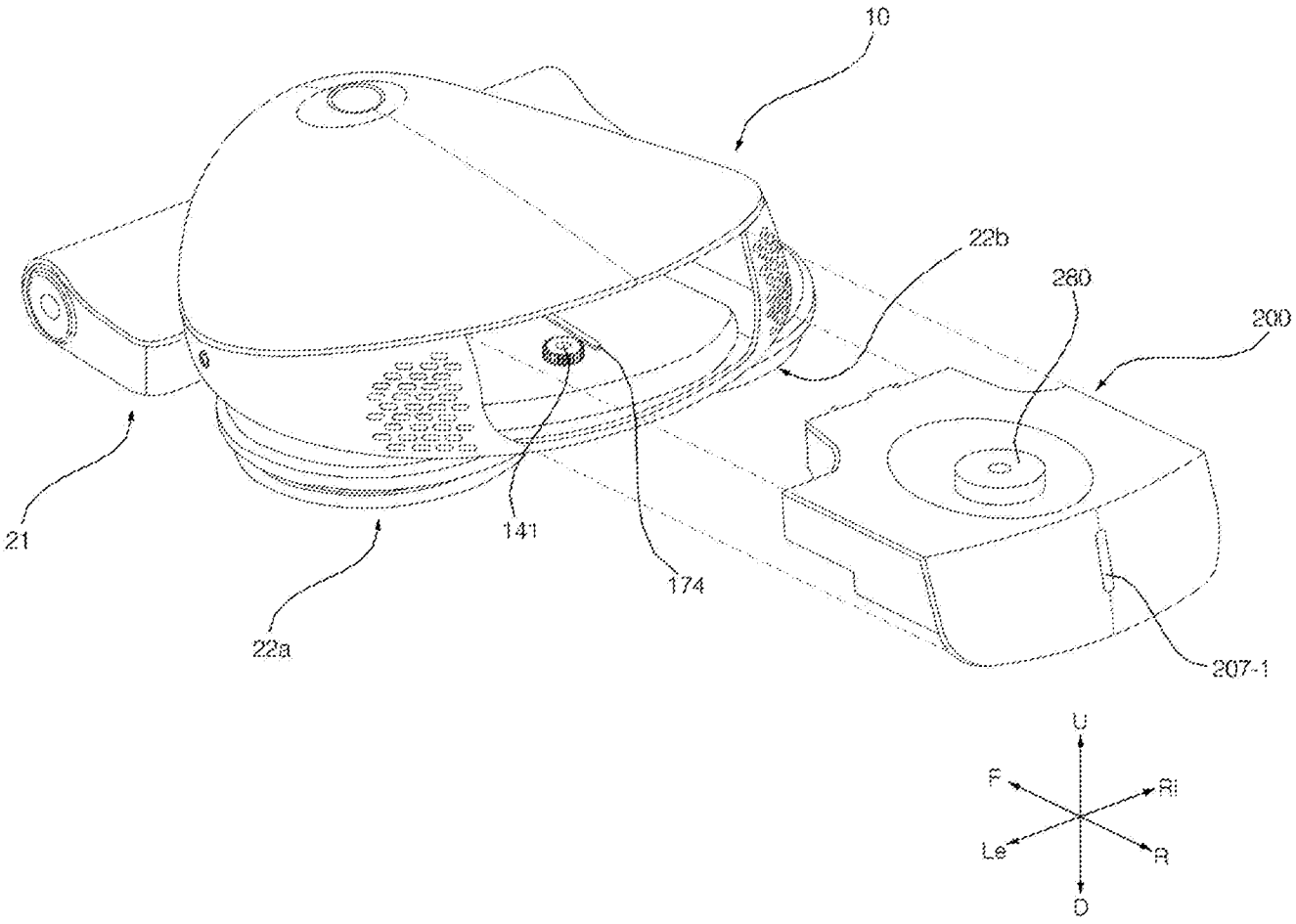
FIG. 2 is a perspective view of the robot cleaner of FIG. 1 when a water tank is separate from a body of the robot cleaner.

The body 10 may define the exterior appearance of the robot cleaner 1. With reference to FIGS. 1 and 2, the body 10 may be cylindrical-shaped. The body 10 may be streamlined when viewed from a side, and the body 10 may be circular shaped or may be elliptical shaped, when viewed from above.

The body 10 may be vertically symmetric. The upper surface of the body 10 may be formed round. The top of the body 10 may be inclined downward in the left and right directions. The body 10 may be open in one direction so that the water tank 200 is inserted into and withdrawn from the body 10. The body 10 may include a water tank insertion part (or water tank insertion recess) 100 into which the water tank 200 is inserted. The body 10 may include an opening which is formed in one side of the body 10, and provides a communication path that allows air to move between the inside and the outside of the body 10 to enhance air permeability.

The body 10 may include an output unit (or user interface) which outputs information about the robot cleaner 1. The body 10 may include a display which outputs image-type information about the robot cleaner 1. The body 10 may include a speaker which outputs sound-type information about the robot cleaner 1.

When coupled to the body 10, the cleaning module 21, 22 may perform cleaning. The cleaning module 21, 22 may include a dry-type cleaning module 21 which performs cleaning without water. The cleaning module 21, 22 may include a wet-type cleaning module 22 which performs cleaning with water.

Figure 5:
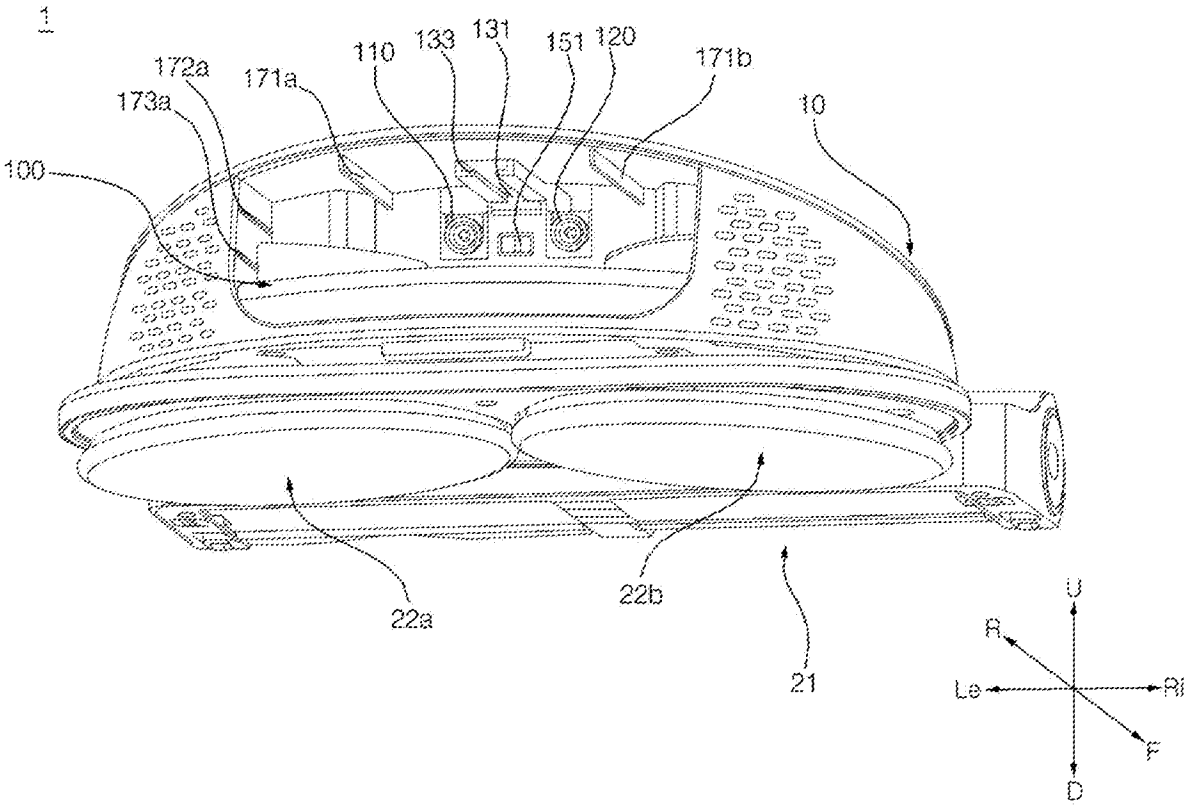
FIG. 5 is a perspective view of the robot cleaner of FIG. 4 seen at a different angle.

Referring to FIG. 5, the cleaning module 21, 22 may be positioned below the body 10. The cleaning modules 21, 22 may be positioned below the body 10 such that the dry-type cleaning module 21 and the wet-type cleaning module 22 are arranged in a forward-backward direction. In another example, the cleaning module 21, 22,0 may be configured such that the dry-type cleaning module 21 is placed forward of the wet-type cleaning module 22.

When rotating, the cleaning module 21, 22 may provide a driving force to the robot cleaner 1. When rotating, the cleaning module 21, 22 may also enable the robot cleaner 1 to rotate.

The dry-type cleaning module 21 may perform cleaning to collect dusts and the like without water. The dry-type cleaning module 21 may be positioned below the body 10.

The wet-type cleaning module 22 may include a mop pad which is rotatable. When a mop pad is dampened by supplied water, the wet-type cleaning module 22 may rotate. A pair of wet-type cleaning modules 22 may be provided on the left and right sides. The wet-type cleaning module 22 may receive the supply of water stored in the water tank 200 through a cleaning module water supply pipe 40.

Figure 6:
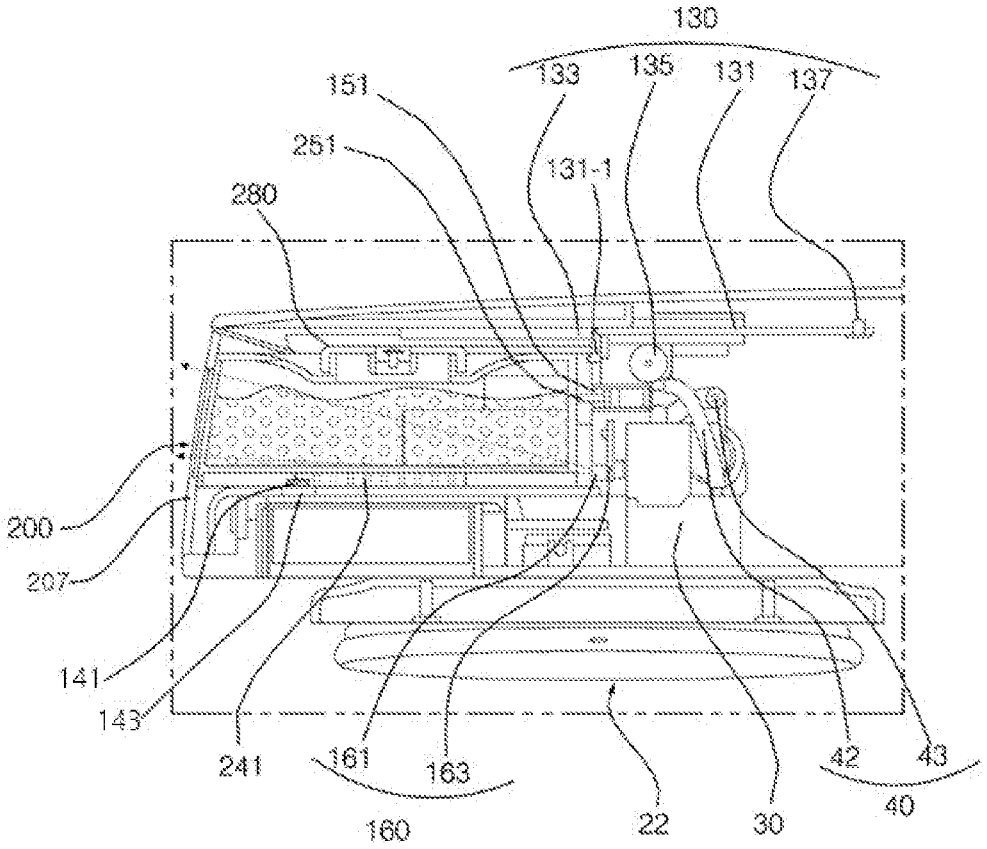
FIG. 6 is a partial cross-sectional view along line A-A' of FIG. 1.
Figure 7:
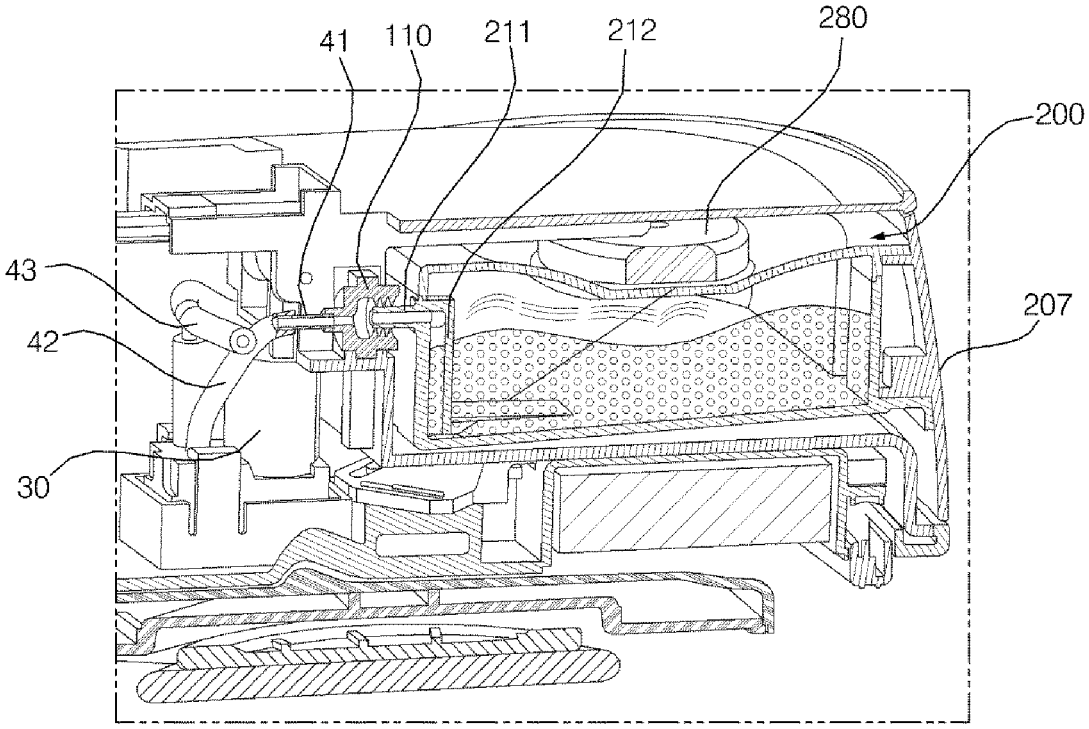
FIG. 7 is a partial cross-sectional view along line B-B' of FIG. 1.

The robot cleaner 1 may include a water supply pump 30. The water supply pump 30 may receive water stored in the water tank 200, and discharge the received water to the wet-type cleaning module 22. As shown in FIGS. 6 and 7, the water supply tank 30 may be connected to a water supply coupler 110 which will be described later. The water supply tank 30 may be connected to the water supply coupler 110 through a tank-pump connection pipe 41 and a tank-pump connection tube 42. The water supply pump 30 may be connected to the wet-type cleaning module 22. The water supply pump 30 may be connected to the wet-type cleaning module 22 through a pump-cleaning module connection pipe 43.

The robot cleaner 1 may include a cleaning module water supply pipe 40. The cleaning module water supply pipe 40 may be positioned inside the body 10. The cleaning module water supply pipe 40 may guide water from the water tank 200 to the wet cleaning module 22. Referring to FIGS. 6 and 7, the cleaning module water supply pipe 40 may guide water from the water tank 200 to the wet-type cleaning module 22. The cleaning module water pipe 40 may include a tank-pump connection pipe 41 which guides water discharged from the water tank 200 to the water supply pump 30.

The cleaning module water supply pipe 40 may include a tank-pump connection tube 43 which guides water from the water supply pump 30 to the wet cleaning module 22. The cleaning module water supply pipe 40 may include the pump-cleaning module connection pipe 43 which guides water discharged from the water supply pump 30 to the cleaning module 21, 22.

Figure 4:
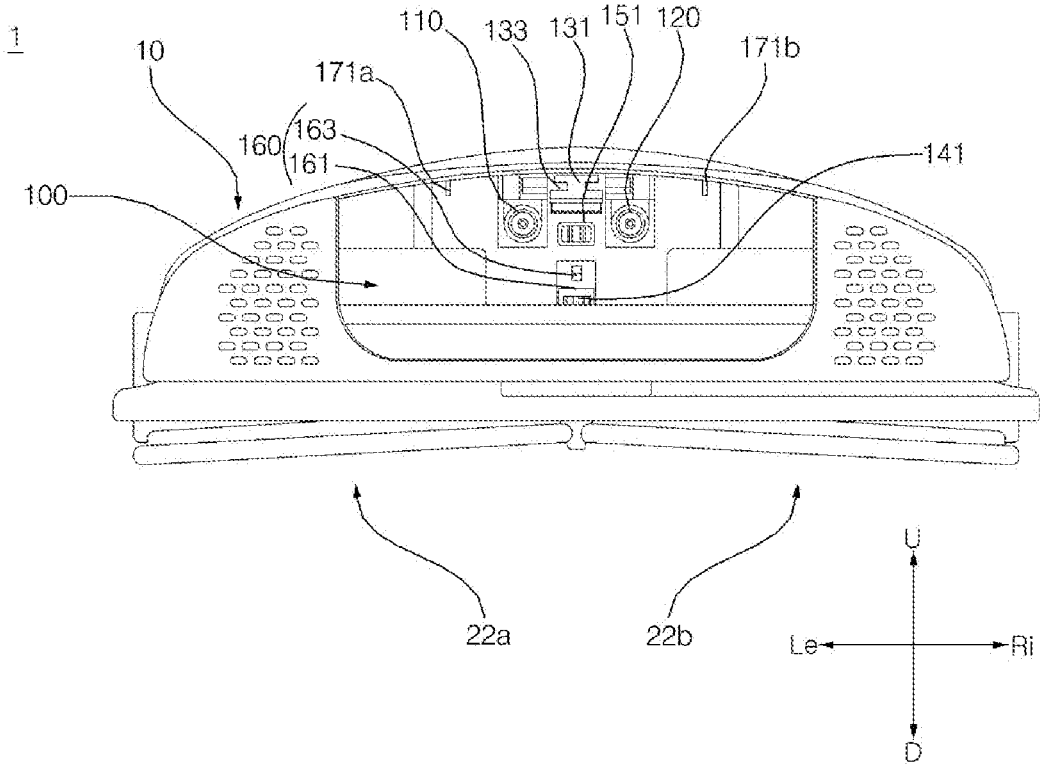
FIG. 4 is a diagram illustrating the rear view of the robot cleaner of FIG. 3 from which a water tank has been separated.

Referring to FIGS. 4 and 5, the robot cleaner 1 may include the water tank insertion part (or water tank insertion recess) 100 into which the water tank 200 is inserted. The water tank insertion part 100 may be open rearward of the body 10. The water tank insertion part 100 may have a substantially rectangle or other shaped space to accommodate the water tank 200.

The water tank insertion part 100 may include the water pipe coupler (or water pipe gasket) 110 which connects an exterior water pipe 211 of the water tank 200 and the cleaning module water supply pipe 40 to each other when the water tank 200 is inserted in the body 10.

At one of the body 10 or the water tank 200, there may be an air pipe 221 (see FIG. 8) which protrudes in a direction toward the other of the body 10 or the water tank 200. At the other of the body 10 or the water tank 200, there may be an air pipe gasket 120 which surrounds the outer circumferential surface of one end of the air pipe 221 when the water tank 200 is inserted into the body 10. In one embodiment, the water tank 200 may include the air pipe 221 protruding toward the body 10, and the water tank insertion part 100 includes the air pipe gasket 120. However, the water accommodation 100 may include an air pipe 221 protruding toward the water tank 200. The air pipe gasket 120 may surround the outer circumferential surface of one end of the air pipe 221 with the water tank 200 being inserted in the body 10.

The robot cleaner 1 may include an elastic force provider (or elastic force module) 130 which provides an elastic force to the water tank 200 in a direction in which the water tank 200 is withdrawn. For example, the water tank insertion part 100 may have the elastic force provider 130 which provides an elastic force to the water tank 200 in a direction in which the water tank 200 is withdrawn. As described below, the elastic force may be applied to the water tank 200 to reduce an amount of force applied by a user to remove the water tank 200 from the body 10.

The robot cleaner 1 may include a component to prevent the water tank 200 from inadvertently being ejected from the body 10. For example, the robot cleaner 1 may include a latch part (or latches) 151 and 251 which allows the water tank 200 and the body 10 to be selectively coupled and decoupled based upon pushing the water tank 200 in a direction in which the water tank 200 is inserted.

The water tank insertion part 100 may include a light source 160 which is positioned to emit light that passed through the water tank 200 and is then discharged to the outside of the body 10. The water tank insertion part 100 may include a body guide part (or guide rail) 170 which guides the water tank 200 when the water tank 200 moves.

Referring to FIGS. 4, 5, and 7, the water tank insertion part 100 may include the water pipe coupler 110. The water pipe coupler 110 may be in the shape of a cylinder (or other shape corresponding to an exterior of the exterior water pipe 211) having a through hole at the center thereof. The water pipe coupler 110 may be in the shape of a pipe with a through hole which penetrates the pipe in a front-rear direction.

A portion of the water pipe coupler 110 may protrude from a middle of the cylindrical-shape water pipe coupler 110 in a circumferential direction. The protruding portion of the water pipe coupler 110 may be rectangular-shaped, as seen in an axial direction of the cylinder shape, so as to help the water pipe coupler 110 to be easily coupled to the body 10. Referring to FIG. 7, the water pipe coupler 110 may be inserted into one sidewall of the water tank insertion part 100 and coupled thereto. The water pipe coupler 110 may be inserted into an inner sidewall of the water tank insertion part 100 and coupled thereto. Referring to FIG. 4, the water pipe coupler 110 may be positioned on an inner sidewall of the water tank insertion part 100 to be vertically symmetric to the air gasket 120.

One end of the water pipe coupler 110 may be connected to the cleaning module water supply pipe 40. The front end of the water supply coupler 110 may be connected to the cleaning module water supply pipe 40. The other end of the water supply coupler 110 may be connected to the exterior water pipe 211. The rear end of the water supply coupler 110 may be connected to the exterior water pipe 211.

A pipe may be formed at the front end of the water pipe coupler 100 to protruding a predetermined length forward, the front end which is connected to the cleaning module water supply pipe 40. The cleaning module water supply pipe 40 may be inserted into the forward protruding pipe of the water pipe coupler 100, so that the cleaning module water supply pipe 40 is coupled to the water pipe coupler 110.

The forward protruding pipe formed in the water pipe coupler 110 to be coupled to the cleaning module water supply pipe 40 may be formed with a predetermined level of elasticity. For example, the forward protruding pipe formed in the water pipe coupler 110 to be coupled to the cleaning module water supply pipe 40 may be formed of a silicon material, a plastic, rubber, or other deformable material.

The water pipe coupler 110 may be shaped such that when the water pipe coupler 110 is not coupled to the cleaning module water supply pipe 40, an inner hole in the forward protruding pipe has a cross-sectional area smaller than a cross-sectional area formed by the outer circumference of the cleaning module water supply pipe 40. This configuration may cause a coupling force between the cleaning module water supply pipe 40 and the water supply pipe coupler 110 to be enhanced.

The water supply coupler 110 may include at least one gasket. With the water tank 200 being inserted in the body 10, at least one gasket may surround the outer circumferential surface of one end of the exterior water pipe 211. At least one gasket may be formed of a material having a predetermined level of elasticity. At least one gasket may be formed of a silicon material or other deformable material. The water pipe coupler 110 may be wholly formed of a silicon material.

At least one gasket may include a hole through which the exterior water pipe 211 is inserted. At least one gasket may be shaped such that, when the exterior water pipe 211 is not inserted into the corresponding gasket, an inner hole formed in the corresponding gasket has a cross-sectional area smaller than a cross-sectional area of the exterior water pipe 211, and thus, a leakage of water possibly occurring when the exterior water pipe 211 is inserted may be prevented. In addition, at least one gasket may provide a force to couple the exterior water pipe 211 and the body 10 to each other and to prevent water from leaking between the exterior water pipe 211 and the water supply coupler 110. At least one gasket may be a plurality of gaskets arranged in a direction in which the water tank 200 is inserted. Referring to FIG. 7, the water pipe coupler 110 may have three-layered gaskets.

The water supply coupler 110 may be positioned at one end of the cleaning module water supply pipe 40. The water supply coupler 110 may be positioned at one end of the exterior water pipe 211. With the water tank 200 being inserted in the body 10, the water pipe coupler 110 may connect the exterior water pipe 211. In this configuration, the water pipe coupler 110 may efficiently prevent a leakage of water possibly occurring when the exterior water pipe 211 is inserted. The water pipe 110 may provide a force to couple the water tank 200 and the body 10 to each other.

Referring to FIGS. 4 and 5, the water tank insertion part 100 may include an air pipe gasket 120. The air pipe gasket 120 may be in the shape of a cylinder having a groove at the center thereof, or may have a different internal shape corresoinding to an exterior shape of the air pipe 221.

The air pipe gasket 120 may have an outwardly protruding portion formed in the middle of the cylinder shape. Considering an axial direction of the cylinder, the protruding portion of the air pipe gasket 120 may be rectangular-shaped so as to help the air pipe gasket 120 to be easily coupled to the body 10.

The air pipe gasket 120 may be inserted into one sidewall of the water tank insertion part 100 and coupled thereto. The air pipe gasket 120 may be inserted into an inner sidewall of the water tank insertion part 100 and coupled thereto. The air pipe gasket 120 may be positioned on the inner sidewall of the water tank insertion part 100 to be vertically symmetric to the water pipe coupler 110.

One end of the air pipe gasket 120 may be connected to the air pipe 221. The rear end of the air pipe gasket 120 may be connected to the air pipe 221. The air pipe gasket 120 may be shaped such that the other end thereof is blocked.

The air pipe gasket 120 may be in the shape of a gasket. The gasket may be formed of a material having a predetermined level of elasticity. For example, the gasket may be formed of a silicon material or other deformable material. In one implementation, the water pipe coupler 110 may be wholly formed of a silicon material.

When air pressure inside the water tank 200 is reduced and water is discharged from the water tank 200 upon operation of the water supply pump 30, the air pipe gasket 120 may allow air to flow into the water tank 200 through the water pipe 221. The air pipe gasket 120 may allow air to pass through between an elastic gasket and the air pipe 221 due to difference in air pressure inside and outside the water tank 200 to thereby flow into the water tank 200 through the air pipe 221.

A gasket of the air pipe gasket 120 may be shaped such that, when the exterior water pipe is not inserted, a hole formed in the air pipe gasket 120 has a size smaller than a cross-sectional area of the air pipe 221, and thus, a force to couple the water tank 200 and the body 10 to each other may be generated.

Figure 17:
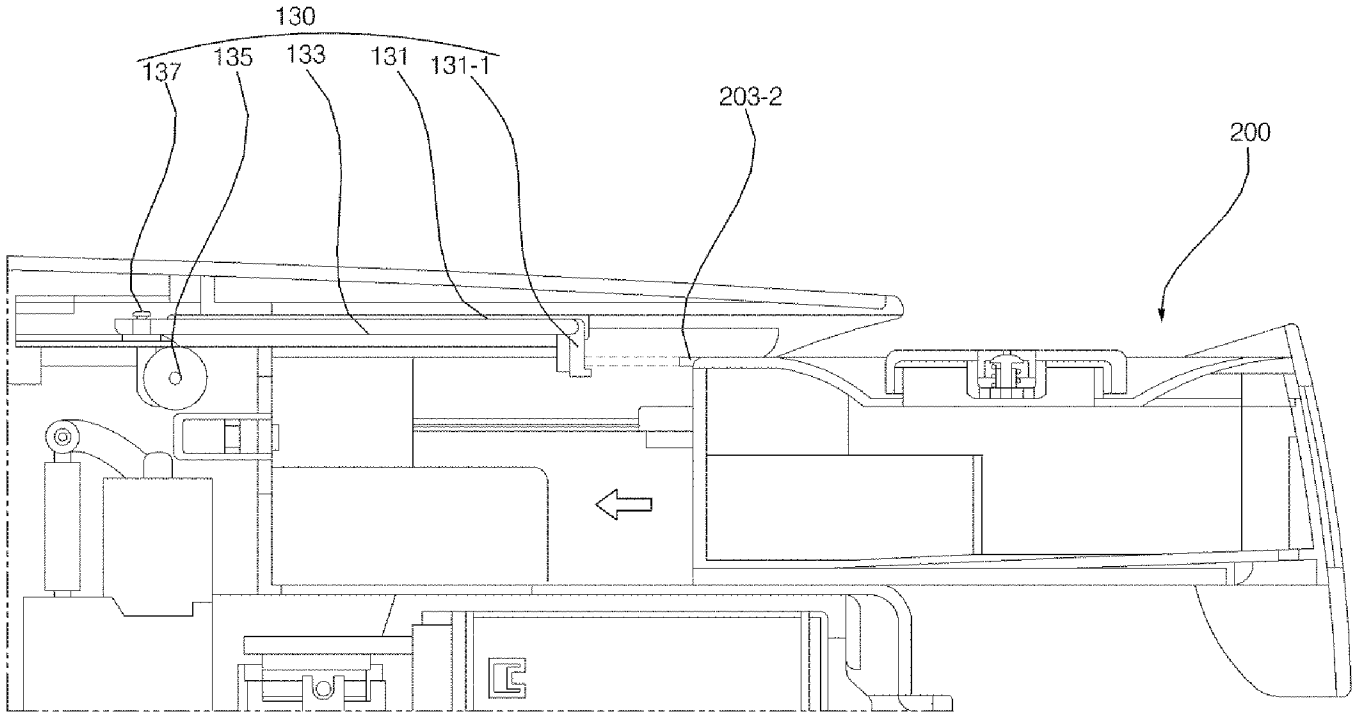
FIG. 17 is a cross-sectional view illustrating operation of an elastic force member.

Referring to FIGS. 5, 6, and 17, the robot cleaner 1 may include an elastic force provider 130 which provides an elastic force in a direction in which the water tank 200 is withdrawn. The elastic force provider 130 may include a moving bar 131 which is positioned to slide in a direction of movement of the water tank 200, and which includes one end in contact with the water tank 200. The elastic force provider 130 may include an elastic element (or spring) 135 which is positioned to be deformed upon movement of the moving bar 131, and which may provide a substantially constant elastic force, regardless of an amount of deformation of the elastic element 135. The elastic force provider 130 may include a moving bar guide 133 which guides the moving bar 131 to move. The elastic force provider 130 may include a sensor or other element for detecting connection of the water tank 200 and the body 10.

The elastic force provider 130 may provide a force to push the water tank 200 in a direction in which the water tank 200 is withdrawn, so that the water tank 200 may be automatically withdrawn from the body 10 even though a user does not pull the water tank 200. The elastic force provider 130 may provide an elastic force greater than a coupling force between the water tank 200 and the body 10 generated by the water pipe coupler 110. The elastic force provider 130 may provide an elastic force greater than a sum of a coupling force between the water tank 200 and the body 10 generated by the water pipe coupler 110 and a coupling force between the water tank 200 and the body 10 generated by the water pipe gasket 120. In this manner, the elastic force provider 130 may allow the water tank 200 to be automatically withdrawn from the body 10 once the water tank 200 and the body 10 are separated from each other at the latch part 151 and 251.

The moving bar 131 may be in the shape of a substantially rectangular plate. The moving bar 131 may be in the shape of a bar which extends in a direction of movement of the water tank 200. The moving bar 131 may be in the shape of a bar extending in a front-rear direction. The moving bar 131 may extend in the front-rear direction with constant thickness and width. The moving bar 131 may have a thickness formed in the upward-downward direction. The moving bar 131 may have a width formed in the left-right direction. The moving bar 131 may have a width longer than a thickness thereof.

The moving bar 131 may be shaped such that the middle of an upper side of the moving bar 131 protrudes upward further. Edges of the both lateral sides of the moving bar 131 may be formed round. Accordingly, a relatively smaller area of the moving bar 131 may contact the moving bar guide 131, thereby reducing friction.

A moving bar contact portion (or moving bar contact surface) 131-1 extending downward to contact the water tank 200 may be formed at one end of the moving bar 131. The moving bar contact portion 131-1 may be formed at the rear end of the moving bar 131. A connection hole may be formed at the other end of the moving bar 131. The connection hole may be formed at the front end of the moving bar 131.

The moving bar 131 may be positioned to move a predetermined distance in the front-rear direction. When inserted into the body 10 and contacting the moving bar 131, the moving bar 131 may move a predetermined distance to a location to be coupled to the body 10. When moving as far forward as possible while maintaining contact with the water tank 200, the moving bar 131 may allow the water tank 200 and the body 10 to be coupled to each other. When moving as far rearward as possible while maintaining contact with the water tank 200, the moving bar 131 may keep the water tank 200 in contact with the body 10 in the upward-downward direction.

When moving as far rearward as possible while maintaining contact with the water tank 200, the moving bar 131 may allow the water tank 200 to move to a location where the water tank 200 is not affected by a resistance force from damping parts 140 and 240.

Referring to FIG. 17, the moving bar 131 may be inserted a predetermined distance into the body 10 and then come into contact with the elastic element 135. The moving bar 131 may be able to slidably move inward of the body 10. While moving, the moving bar 131 may deform the elastic element 135 to generate an elastic force.

The moving bar 131 may transfer the elastic force generated by the elastic element 135 to the water tank 200, thereby providing a force to push the water tank 200 in a direction in which the water tank 200 is withdrawn. By providing a force to push the water tank 200 in the direction in which the water tank 200 is withdrawn, the moving bar 131 may help the water tank 200 to be withdrawn effectively.

The moving bar 131 may be positioned such that one end thereof (e.g. the moving bar contact portion 131-1) is able to come into contact with the water tank 200. The moving bar 131 may be positioned such that the rear end thereof is able to come into contact with the water tank 200. One end of the moving bar 131 may be connected to the elastic element 135, for example, the front end of the moving bar 131 may be connected to the elastic element 135.

The moving bar 131 may be positioned inside the body 10. The moving bar 131 may be positioned in the upper side of the water tank insertion part 100. The moving bar 131 may be positioned to come into contact with the moving bar guide 133. The moving bar 131 may be positioned such that at least part thereof is able to be inserted into the moving bar guide 133. Being inserted into the moving bar guide 133, the moving bar 131 may move only in the front-rear direction.

Both left and right sides of the moving bar 131 may be at least partially covered by the moving bar guide 133. The top and bottom sides of the moving bar 131 may be also at least partially covered by the moving bar guide 133. The moving bar 131 may move with being guided by the moving bar guide 133.

The moving bar 131 may be shaped such that the middle of the upper side of the moving bar 131 protrudes upward further. Edges of the both lateral sides of the moving bar 131 may be formed round. Thus, a relatively small area of the moving bar 131 may contact the moving bar guide 131, thereby reducing friction.

One end of the moving bar 131 may come into contact with the water tank 200 to support the water tank 200. Referring to FIG. 6, the moving bar 131 may include the moving bar contact portion 131-1, which is bent downward from one end of the moving bar 131 to extend downward. The moving bar contact portion 131-1 may be bent downward from the rear end of the moving bar 131 to extend downward.

The moving bar contact portion 131-1 may pass through a hole, which is formed in the middle of the bottom of the moving bar guide 133 covering the bottom of the moving bar 131, to extend downward. Protrusions may be respectively formed on the left and right sides of the moving bar contact portion 131-1 to cover the bottom of the moving bar guide 133 in the upward-downward direction, so that the moving bar 131 may be effectively guided by the moving bar guide 133. The moving bar contact portion 131-1 may have a bottom end protruding toward the water tank 200 to contact and be engaged with a contact protrusion 203-2 formed in a upper wall 203 of the water tank 200.

Referring to FIG. 5, the moving bar guide 133 may extend in a direction of movement of the moving bar 131. The moving bar guide 133 may extend a predetermined length in the front-rear direction. The moving gar guide 133 may have a length long enough to guide the moving bar 131 to move within a range of movement of the moving bar 131. The moving guide 133 may have a length long enough to cover at least part of the moving bar 133 when the moving bar 131 has moved as far forward or rearward as possible.

The moving bar guide 133 may be positioned in the upper side of the water tank insertion part 100. The moving bar guide 133 may protrude downward from the upper side of the water tank insertion part 100. The moving bar guide 133 may be shaped such that the left and right parts of the moving bar guide 133 protrude downward from the upper side of the water tank insertion part 100 to be bent to face each other. The moving bar guide 133 may extend forward further than an inner wall of the water tank insertion part 100 to guide the moving bar 131 to move.

The left and right sides of the moving bar guide 133 may be positioned to contact the moving bar 131. The upper and bottom sides of the moving bar guide 133 may be positioned to contact the moving bar 131. As the bottom side of the moving bar guide 133 is open longitudinally at a middle portion in the front-rear direction, the moving bar contact portion 131-1 may pass through the hole to extend downward. Inside the moving bar guide 133, there may be a space in which the moving bar 131 moves.

Referring to FIGS. 6 and 17, the elastic element 135 may be positioned to be deformed upon movement of the moving bar 131, and may provide a substantially constant elastic force, regardless of an amount of deformation of the elastic element 135. The moving bar guide 133 may be positioned inside the body 10.

The elastic element 135 may be provided as a plate spring. For example, the elastic element 135 may be in the shape of a rolled metal plate. The elastic element 135 may be provided as a constant spring. When the elastic element 135 is implemented as a plate spring, the elastic element 135 may have a rolling axis is horizontal in the left-right direction, and thus, the elastic element 135 may provide an elastic force in the front-rear direction.

One end of the elastic element 135 may be coupled to the moving bar 131. The elastic element 135 may have a connection hole formed at the front end thereof, and the elastic element 135 may be coupled to the moving bar 131 through the connection hole. The elastic element 135 may be coupled to the moving bar 131 by a screw. The elastic element 135 may be coupled to the bottom of the moving bar 131.

Upon movement of the moving bar 131, a spring of the elastic element 135 may be deformed to generate an elastic force. The elastic element 135 may provide an elastic force to the water tank 200 in a direction in which the water tank 200 is withdrawn. By providing a force to push the water tank 200 in the direction in which the water tank 200 is withdrawn, the elastic element 135 may allow the water tank 200 to be automatically withdrawn from the body 10 even when a user does not pull the water tank 200.

The elastic element 135 may provide an elastic force greater than binding coupling force between the water tank 200 and the body 10 generated by the water pipe coupler 110. The elastic element 135 may provide an elastic force greater than a sum of binding coupling force between the water tank 200 and the body 10 generated by the water pipe coupler 110 and a coupling force between the water tank 200 and the body 10 generated by the air pipe gasket 120. Accordingly, the elastic element 135 may allow the water tank 200 to be automatically withdrawn from the body 10 once the water tank 200 and the body 100 are separated from each other at the latch part 151 and 251.

The elastic force provider 130 may include a moving bar connection screw 137. The moving bar connection screw 137 may be used to couple the moving bar 131 and the elastic element 135. The moving bar connection screw 137 may pass through a connection hole formed in the moving bar 131 and a connection hole formed in the elastic element 135 so as to couple together the moving bar 131 and the elastic element 135.

The robot cleaner 1 may include a rack 241 formed on an outer surface of the water tank 200. The robot cleaner 1 may include one or more pinions 141 which are positioned inside the body 10 and engaged with the rack 241 to rotate when the water tank 200 is withdrawn. The robot cleaner 1 may include a damper 143 which is axially connected to any one of the one or more pinions. The damper 143 may provide a resistance force when a pinion 141 connected to the damper 143 rotate.

Referring to FIG. 6, the water tank insertion part 100 may include a body damping part (or body dampener) 140. The body damping part 140 may include a pinion 141 which are positioned to be engaged with the rack 241 to rotate. The body damping part 140 may include a damper 143 which provides a resistance force when the pinion 141 rotate.

The body damping part 140 may provide a resistance force to the water tank 200 when the water tank 200 moves. The body damping part 140 may allow the water tank 200 to move at a predetermined speed or less. The body damping part 140 may allow the water tank 200 to move at a predetermined acceleration rate or less.

In doing so, the body damping part 140 may prevent the water tank 200 from moving abruptly. The body damping part 140 may suppress water stored in the water tank 200 from flowing. The body damping part 140 may suppress the water tank 200 from vibrating because of water flow. The body damping part 140 may prevent a leakage of the water stored in the water tank 200.

When the water tank 200 is withdrawn from the body 10, the body damping part 140 may prevent the water tank 200 from completely detaching from the body 10 to thereby fall down. When providing an elastic force in a direction in which the water tank 200 is withdrawn, the elastic force provider 130 may provide a resistance force to the water tank 200 so that all the forces applied to the water tank 200 are kept in balance.

Referring to FIG. 6, the pinion 141 may be engaged with the rack 241 to rotate when the water tank 200 is withdrawn. The pinion 141 may be positioned in the body 10. The pinion 141 may be positioned in one side of the water tank insertion part 100. The pinion 141 may be positioned in the lower side of the water tank insertion part 100.

The pinion 141 may be axially connected to the body 10 to rotate. The pinion 141 may be axially connected to the damper 143 to receive a resistance force from the damper 143 from a direction opposite to a direction in which the pinion 141 rotates.

In other embodiments, the robot cleaner 1 may include a plurality of pinions 141. The plurality of pinions may have different gear ratios. The plurality of pinions 141 may be engaged with each other to rotate. Any one of the plurality of pinions may be axially connected to the damper 143. The plurality of pinions may include a first pinion engaged with the rack 241 and a second pinion axially connected to the damper 143, and the first pinion and the second pinion may be connected to each other. The plurality of pinions may be guided by a damping guide 145 provided in the water tank 200, and may come into contact with the rack 241.

Referring to FIG. 6, the damper 143 may be axially connected to the pinion 141, and provide a resistance force when the pinion 141 connected to the damper 143 rotates. The damper 143 may include a moving member axially connected to the pinion 141, and a fixed member in contact with the moving member. Accordingly, a resistance force may be generated due to friction between the moving member and the fixed member.

The damper 143 may accommodate a fluid having a predetermined level of viscosity, and may include the moving member, which is axially connected to the pinion 141 and rotates in the fluid. Accordingly, a resistance force may be generated due to friction between the fluid and the moving member.

The damper 143 may be a rotary damper. When the pinion 141 connected to the damper 143 rotates, the damper 143 may provide a torque in a direction opposite to a direction of rotation of the pinion 141. In doing so, the damper 143 may prevent the connected pinion 141 from rotating abruptly. The damper 143 may allow the pinion 141 to rotate at a predetermined speed or less. The damper 143 may allow the pinion 141 to rotate at a predetermined acceleration rate or less.

The damper 143 may provide a resistance force to the water tank 200 using the pinion 141. The damper 143 may provide a force through the pinion 141 to the water tank 200 in a direction opposite to a direction of movement of the water tank 200. The damper 143 may prevent the water tank 200 from moving abruptly. The damper 143 may allow the water tank 200 to move at a predetermined speed or less. The damper 143 may allow the water tank 200 to move at a predetermined acceleration rate or less.

The damper 143 may be positioned in one side of the water tank insertion part 100. The damper 143 may be positioned in the lower side of the water tank insertion part 100. The damper 143 may be inserted into the lower side of the water tank insertion part 100.

The robot cleaner 1 may include the latch part 151 and 251 which enable the water tank 200 and the body 10 to be coupled to and decoupled from each other upon push of the water tank 200 in a direction in which the water tank 200 is inserted. A latch protrusion 251 may be formed in one side of the water tank 200. Referring to FIGS. 4 to 6, a latch groove 151 able to be coupled to a latch protrusion 251 may be formed on one side of the water tank insertion part 100. The latch groove 151 may make up a latch part along with the latch protrusion 251.

The latch part may allow the water tank 200 and the body 10 to be coupled to and decoupled from each other by an operation of pushing the water tank 200 in a direction in which the water tank 200 is inserted. The water tank 200 and the body 10 may be coupled to each other as the latch protrusion 251 is inserted into the latch groove 151.

The latch groove 151 may include a projection which projects toward the latch protrusion 251. The latch groove 151 may include inward projections respectively formed on the left and right sides thereof. The latch groove 151 may include projections which are able to be engaged with projections formed in the latch protrusion 251 and thereby coupled to the latch protrusion 251. The latch groove 151 may be shaped such that end portions of projections thereof projecting toward the latch protrusion 251 are engaged with the latch protrusion 251. The latch groove 151 may be configured to remain coupled to the latch protrusion 251 when the water tank 200 is pushed once, and to be decoupled from the latch protrusion 251 when the water tank 200 is pushed again.

When coupled to the latch protrusion 251, the latch groove 151 may help the water tank 200 to stop at a predetermined location. When coupled to the latch protrusion 251, the latch groove 151 may couple the water tank 200 and the body 100 to each other.

The latch groove 151 may include a connection detection sensor that may detect a connection between the water tank 200 and the body 10. For example, when the latch protrusion 251 and the latch groove 151 become coupled to each other, the latch groove 151 may generate a signal indicating a connection between the water tank 200 and the body 10. In one example, the latch groove 151 may include a switch by which the light source 160 is turned on when the water tank 200 and the body 10 become coupled to each other.

The latch groove 151 may be positioned inside the body 10. The latch groove 151 may be positioned on an inner wall of the water tank insertion part 100. The latch groove 151 may be positioned at a location where the latch groove 151 can be coupled to the latch protrusion.

The light source 160 may be preset to allow emitted light to pass through the water tank 200 and be then emitted to the outside of the body 10. The light source 160 may be positioned inside the body 10. Referring to FIGS. 4 and 6, the light source 160 may be positioned to face a surface of the water tank 200 located in a direction in which the water tank 200 is inserted. The light source 160 may be positioned in the body 10 to face the front surface of the water tank 200.

The light source 160 may be positioned in the body 10 to pass through a hole formed in an inner wall of the water tank insertion part 100 and then face the front surface of the water tank 200. Due to this structure, light emitted from the light source 160 may be effectively discharged to the outside of the body 10. The light source 160 may include a Light Emitting Diode (LED) 161 which emit light. The light source 160 may include a light source substrate 163 on which the LED 161 are arranged.

The light source 160 may emit light once the water tank 200 is coupled to the body 10. Before the water tank 200 is coupled to the body 10, the light source 160 may remain in the off sate. The robot cleaner 1 may include a connection detection sensor for detecting connection between the water tank 200 and the body 10. If connection between the water tank 200 and the body 10 is detected by the connection detection sensor, the light source 160 may emit light. If connection between the water tank 200 and the body 10 is not detected by the connection detection sensor, the light source 160 may remain in the off state.

The light source 160 may emit light with different levels of intensity. The light source 160 may emit light with different levels of intensity, depending on whether the water tank 200 and the body 10 are coupled to each other. The light source 160 may emit light with different levels of intensity based on information about a level of water stored in the water tank 200.

The light source 160 may emit light of different colors. The light source 160 may emit light of different colors, depending on whether the water tank 200 and the body 10 are coupled to each other. The light source 160 may emit light of different colors based on information about a level of water stored in the water tank 200.

The light source 160 may flash to emit light. The light source 160 may flash to emit light based on information about connection between the water tank 200 and the body 10. When the water tank 200 and the body 10 are decoupled from each other, the light source 160 may flash to emit light. The light source 160 may emit light based on information about a level of water stored in the water tank 200. The light source 160 may flash to emit light when water stored in the water tank 200 is less than a predetermined level.

The light source 160 may notify a use about whether the water tank 200 and the body 10 are properly connected. For example, when the water tank 200 and the body 10 are properly connected, light emitted from the light source 160 may pass through the water tank 200 and may then be discharged to the outside of the body 10.

The water tank insertion part 100 may include a body guide part 170. The body guide part 170 may guide movement of the water tank 200 when the water tank 200 is inserted into the body 10. The body guide part 170 may be positioned inside the body 10. The body guide part 170 may be positioned inside the water tank insertion part 100.

Referring to FIGS. 2, 4, and 5, the body guide part 170 may include an upper body guide part 171 positioned in the upper side of the water tank insertion part 100. The body guide part 170 may include side body guides 172 and 173 positioned in lateral sides of the water tank insertion part 100. The body guide part 170 may (include a lower body guide 174 positioned in the lower side of the water tank insertion part 100.

The upper body guide 171 may be a pair of left and right protruding lines in the upper side of the water tank insertion part 100. The upper body guide 171 may extend a predetermined length in a front-rear direction. When the water tank 200 is inserted into the body 10, the upper body guide 171 may come into contact with the upper surface of the water tank 200. The upper body guide 171 may have a round-shaped rear end which comes into contact with the water tank 200. The body guide 171 may protrude downward further than the moving bar guide 133 so that the body guide 171 is not contacted by the moving guide 133 when the water tank 200 is inserted into the body 10.

The side body guides 172 and 173 may be a pair of lines which protrude from both lateral surfaces of the water tank insertion part 100, and which are vertically symmetric to each other. The side body guides 172 and 173 may extend a predetermined length in the front-rear direction. When the water tank 200 is being inserted into the body 10, the side body guides 172 and 173 may contact the left and right surfaces of the water tank 200 when the water tank 200 is inserted into the body 10.

The lower body guide 174 may be a protruding line formed in the lower side of the water tank insertion part 100. The lower body guide 174 may extend a predetermined length in the front-rear direction. When the water tank 200 is inserted into the body 10, the lower body guide 174 may come into contact with the lower surface of the water tank 200. The lower body guide 174 may be formed adjacent to the pinion 141. The lower body guide 174 may be positioned on the right side of the pinion 141 with a predetermined distance from the pinion 141.

The water tank 200 may be in a rectangular shape. The water tank 200 may be formed of a material which allow light to pass therethrough. The water tank 200 may be formed transparent. The water tank 200 may be formed translucent. Referring to drawings from FIG. 8, the water tank 200 may have a shape corresponding to a shape of the body 10. The water tank 200 may have a shape that protrudes or is recessed to correspond to the shape of the body 10.

As seen from the front, the water tank 200 may be shaped such that an upper left portion of the water tank 200 is recessed inward of the water tank 200. Similarly, as seen from the front, the water tank 200 may be shaped such that an upper right portion of the water tank 200 is recessed inward of the water tank 200.

As seen from the front, the water tank 200 may be shaped such that a lower left portion of the water tank 200 is recessed inward of the water tank 200 with a curvature. As seen from the front, the water tank 200 may be shaped such that the lower left portion of the water tank 200 is recessed inward of the water tank 200 further than the upper left portion.

As seen from the front, the water tank 200 may shaped such that a lower right portion of the water tank 200 is recessed inward of the water tank 200 with a curvature. As seen from the front, the water tank 200 may be shaped such that the lower right portion of the water tank 200 is recessed inward of the water tank 200 further than the upper right portion.

The water tank 200 may include a front wall 201 located at the front (e.g., closer to the dry cleaning module 21). The water tank 200 may include a rear wall 202 located at the rear (e.g., further from the dry cleaning module 21). The water tank 200 may include an upper wall 203 located at the top (e.g., spaced from the floor). The water tank 200 may include a lower wall 204 located at the bottom (e.g., adjacent to the floor). The water tank 200 may include left and right side walls 205 located on the left and right sides. The front wall 201 of the water tank 200 may be T-shaped.

At least part of the water tank 200 being exposed to the outside of the body 10 may allow light to pass therethrough, so that light emitted from the light source 160 passes through the corresponding part of the water tank 200 and is then discharged to the outside of the body 10.

The water tank 200 may include an exterior water pipe 211 which protrudes from the outer surface of the water tank 200 in a direction in which the water tank 200 is inserted. The water tank 200 may include the exterior water pipe 211 which protrudes forward from the front wall 201. The water tank 200 may include the exterior water pipe 211 which is able to be coupled to the water pipe coupler 110.

At one of the body 10 or the water tank 200, there may be an air pipe 221 which protrudes toward the other thereof. At the other of the body 10 or the water tank 200, there may be an air pipe gasket 120 which surrounds the outer circumference of one end of the air pipe 221 with the water tank 200 being inserted into the body 10.

The water tank 200 may include the air pipe 221 which protrudes toward the body 10. The water tank 200 may include the air pipe gasket 120 which surrounds the outer circumference of one end of the air pipe 221 with the water tank 200 being inserted into the body 10. The water tank 200 may include the air pipe 221 which protrudes forward from the front wall 201. The water tank 200 may include the air pipe 221 which is positioned on the front wall 201 and able to be coupled to the air pipe gasket 120.

The water tank 200 may include the latch protrusion 251 formed on the front wall 201. The rear wall 202 may be convex rearward. The rear wall 202 may be shaped such that a lower portion thereof protrudes further than an upper portion.

The rear wall 202 may be inclined in the front-rear direction. At least part of the rear wall 202 may be formed with a curvature as the same as a curvature of the rear surface of the body 10, so that the rear wall 202 appears to be seamlessly connected to the body 10. At least part of the rear wall 202 may be in the form of a plate which is flat in the left-right direction. At least part of the rear wall 202 may be formed with a curvature as the same as a curvature of a water tank cover 207 so as to form a contact surface. The water tank 200 may include the water tank cover 207 which covers a surface facing outward of the body 10. The rear wall 202 may come into contact with the water tank cover 207.

The rear wall 202 may include a rear wall protrusion 202-1 which is formed at the center thereof, and which protrudes rearward. Water may be accommodated inside the rear wall protrusion 202-1. At least part of the rear wall protrusion 202-1 may be exposed to the outside of the body 10 through a water level window 207-1 which will be described later. At least part of the rear wall protrusion 202-1, which is exposed to the outside of the body 10, may be formed of a material which allows light to pass therethrough. At least part of the rear wall protrusion 202-1, which is exposed to the outside of the body 10, through the water level window 207-1, may be transparent.

At least part of the rear wall protrusion 202-1, which is exposed to the outside of the body 10, may have a color. At least part of the rear wall protrusion 202-1, which is exposed to the outside of the body 10, may have a pattern. At least part of the rear wall protrusion 202-1, which is exposed to the outside of the body 10, may be formed of a material different from a material which makes up of the rear wall 202.

The water tank 200 may have a water supply hole formed in the upper side thereof. The Water supply hole may be circular-shaped. The rear wall 202 may include a water tank cap 280 by which the water supply hole is opened and closed.

An upper wall recess 203-1 may be formed in the rear wall 202. The upper wall recess 203-1 is formed as the surroundings of the water supply hole formed at the center of the upper wall 203 is recessed downward. The upper wall recess 203-1 may be in the shape in which the edge thereof is connected to the upper wall 203 and the upper wall 203-1 is gradually recessed from the edge toward the center thereof. The upper wall recess 203-1 may be in the shape of a circle which is a concentric circle having a different radius than that of the circular-shaped water supply hole. The upper wall recess 203-1 may reduce the upward protruding length of the water supply hole and the water tank cap 280 from the upper wall 203, thereby making the water tank 200 to be easily inserted into and withdrawn from the body 10.

The water tank 200 may include a contact protrusion 203-2 which protrudes forward from the forward center of the upper wall 203. The water tank 200 may include the contact protrusion 203-2 which is positioned to contact the moving bar 131. The contact protrusion 203-2 may come into contact with the moving bar contact portion 131-1. The contact protrusion 203-2 may come into contact with a protruding end of the moving bar contact portion 131-1 to be coupled thereto, thereby enhancing a coupling force between the moving bar 131 and the water tank 200. Thus, an elastic force may be effectively transferred from the elastic force provider 130 to the water tank 200.

The water tank 200 may include a rack 241 formed on an outer surface thereof. The lower wall 204 of the water tank 200 may have an inclined inner surface. The inner surface of the lower wall 204 may be inclined downward toward the front wall 201. The inner surface of the lower wall 204 may be inclined downward toward an interior pipe 212, which will be described later, so as to allow water stored in the water tank 200 to be effectively discharged from the tank 200 through the inner pipe 212. The rack 241 may be positioned on the outer surface of the lower wall 204. A damping guide 245 guiding to the pinion 141 to move may be positioned on the outer surface of the lower wall 204.

A water tank guide 270 for guiding the water tank 200 to move when the water tank 200 is inserted into the body 10 may be positioned on the outer surface of the lower wall 204. A water tank connection hole 209, into which a fastening member for fastening the water tank 200 and the water tank cover 207 to each other is inserted, may be formed on the lower wall 204. The water tank 200 may be in the shape in which that the left and right side walls 205 are vertically symmetric to each other.

The water tank 200 may store water to be supplied to the cleaning module 21, 22. The water tank 200 may include a water pile which guides the stored water to be discharged. The water tank 200 may include a hole penetrating the water tank 200, the hole which is positioned closer to the upper side of the water tank 200 than the lower side of the water tank 200 so as to prevent the water from being discharged due to self-weight of the water.

The water tank 200 may include the air pipe 221 not to restrict the water stored in the water tank 200 from being discharged because air pressure inside the water tank 200 is reduced upon operation of the water supply pump 30. The water tank 200 is provided to be inserted into and withdrawn from the body 10 in a horizontal direction, thereby preventing residual water from remaining in the water tank 200.

The water tank 200 may be withdrawn from the body 10. The water tank 200 may be withdrawn from the body 10 in a direction vertical to the upward-downward direction. The water tank 200 may be withdrawn from the body 10 in a horizontal direction. The water tank 200 may be inserted into the water tank insertion part 100 formed on the side surface of the body 10, and coupled to the body 10. The water tank 200 may be inserted into the water tank insertion part 100 which is formed open rearward of the body 10.

The water tank 200 may be positioned above the wet cleaning module 22. The water tank 200 may be positioned behind the dry-type cleaning module 21. Based on a direction from left to right, the water tank 200 may be positioned to have a center of gravity between rotation axes of the left and right wet-type cleaning modules 22. Based on a direction from front to rear, the water tank 200 may be positioned to have a center of gravity behind rotation axes of the left and right wet-type cleaning modules 22.

The water tank 200 may include the water tank cover 207 which covers a surface facing outward of the body 10. The water tank 200 may be provided to allow light emitted from the light source 160 to be discharged to the outside of the body 10 through the water tank cover 207. Referring to FIGS. 8 to 12, the water tank cover 207 may be in the shape of a rectangular plate. The water tank cover 207 may be in the shape having rounded edges.

The water tank cover 207 may be convex rearward. The water tank cover 207 may be shaped such that the lower portion of the water tank cover 207 protrudes rearward further than the upper portion of the water tank cover 207. The water tank cover 207 may be inclined in the front-rear direction. The water tank cover 207 may be formed with a curvature as the same as a curvature of the rear surface of the body 10, so that the water tank cover 207 appears to be seamlessly connected to the body 10. At least part of the water tank cover 207 may be formed with a curvature as the same as a curvature of the rear wall 202 so as to form a contact surface.

When coupled to the water tank 200, the water tank cover 207 may protrude upward further than the upper wall 203. When coupled to the water tank 200, the water tank cover 207 may protrude downward than the lower wall 204. As being coupled to the water tank 200, the water tank cover 207 may have left and right lengths as the same as lengths of the left and right side walls 205.

The water tank cover 207 may partially define part of the exterior appearance of the robot cleaner 1. The water tank cover 207 may be formed of a material consistent with a material of the body 10 which defines the exterior appearance of the cleaning robot 1. The water cover 207 may be in the shape that appears seamlessly connected to the body 10 to define the exterior appearance of the robot cleaner 1. Configured as above, the water tank cover 207 may allow a user to grip the robot cleaner 1 more conveniently and enhance an aesthetic appearance of the robot cleaner 1.

Figure 3:
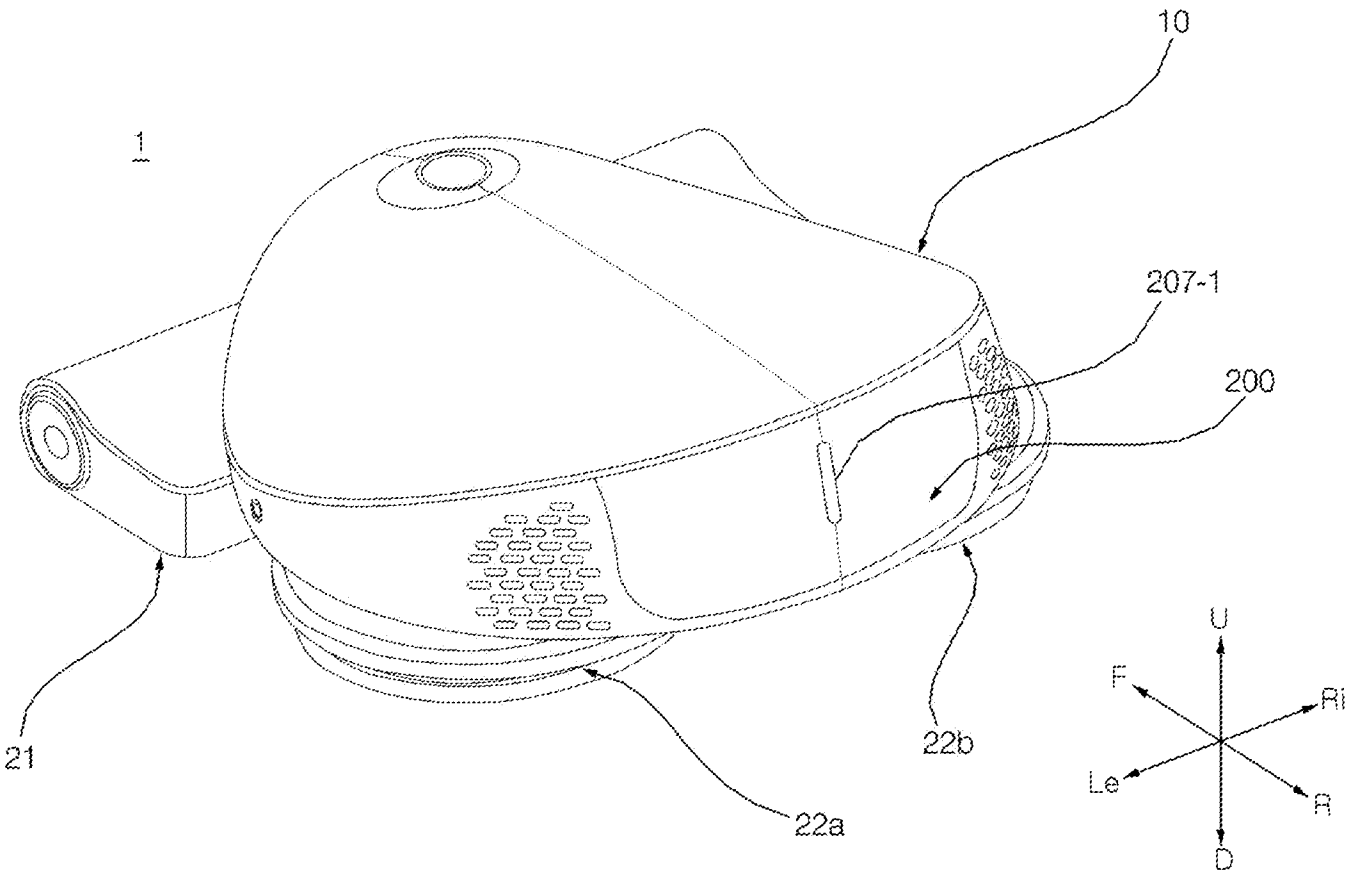
FIG. 3 is a rear view of the robot cleaner of FIG. 1.
Figure 13:
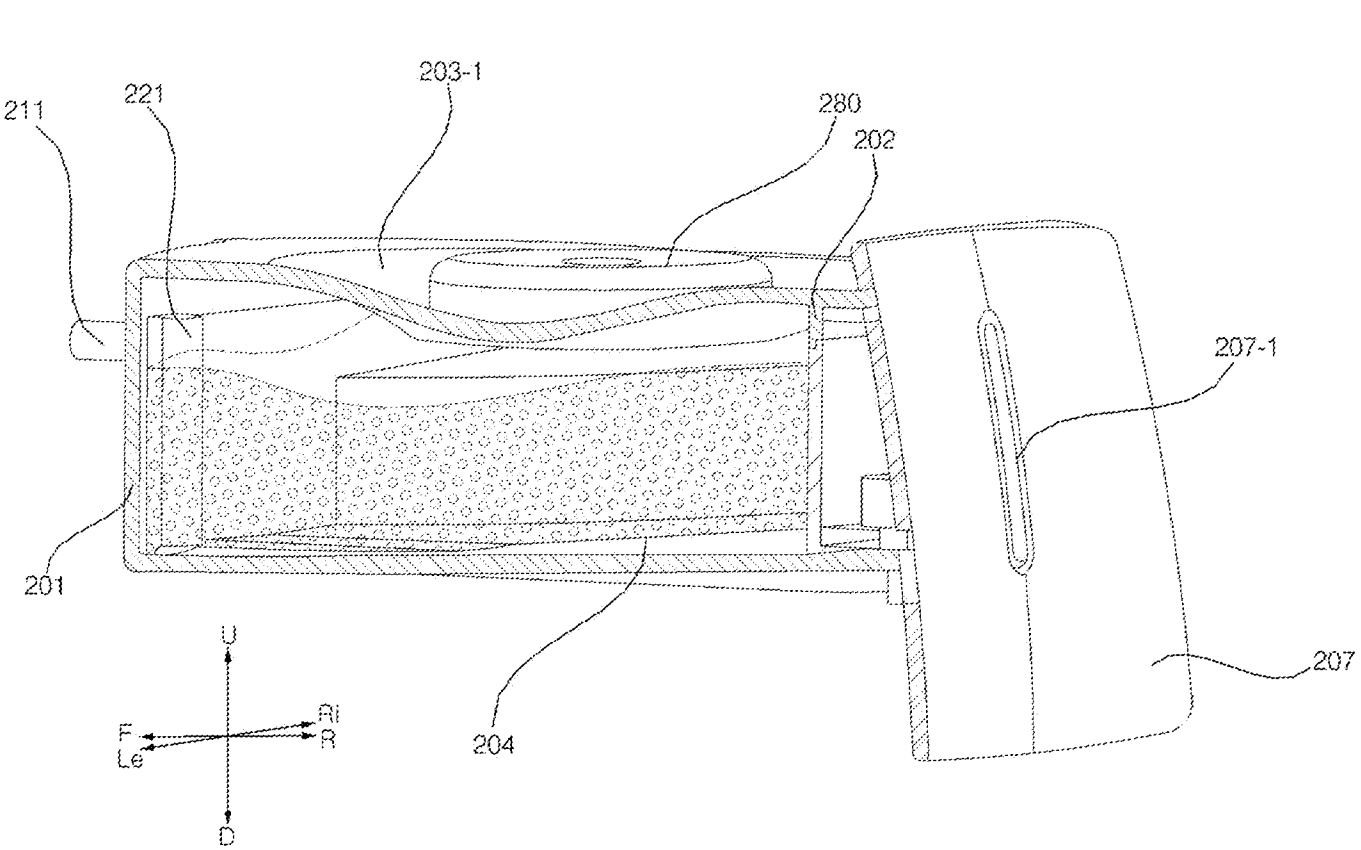
FIG. 13 is a cross-sectional view along line D-D' of FIG. 10.
Figure 14:
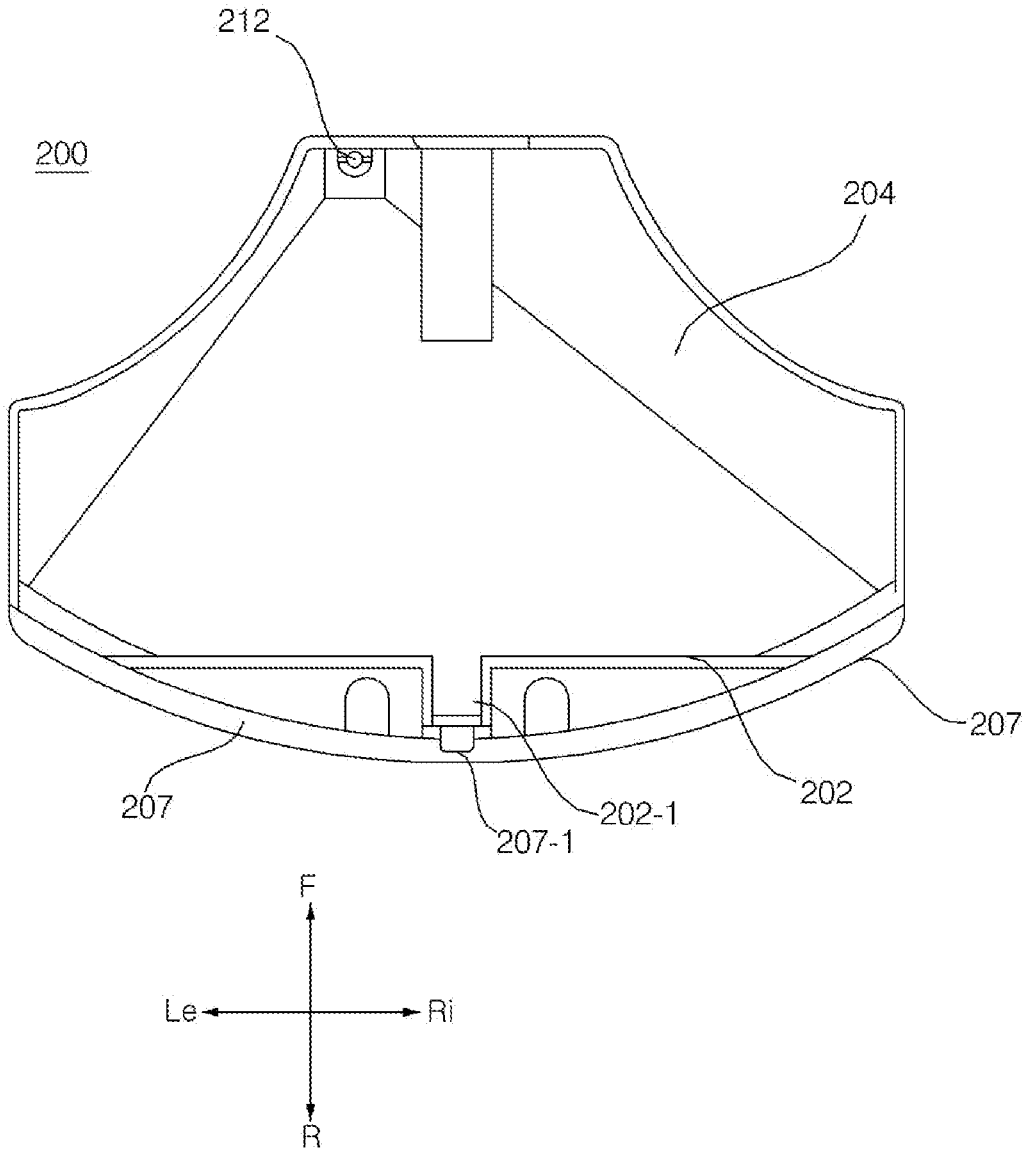
FIG. 14 is a cross-sectional view along line E-E' of FIG. 10.

In the middle of the water tank cover 207, there may be a water level window 207-1 which allows light to pass therethrough. Referring to FIGS. 3 and 13, the water level window 207-1 may be vertically formed in the middle of the water tank cover 207 to allow a user to check a water level easily.

Light emitted from the light source 160 may pass through the water tank 200 and be then discharged to the outside of the body 10 through the water level window 207-1. Referring to FIG. 6, light emitted from the light source 160 may be incident onto the water tank 200 through the front wall 201 and/or the lower wall 204, pass through water stored in the water tank 200, and be then discharged to the outside of the body 10 through the rear wall protrusion 202-1 and the water level window 207-1.

Figure 12:
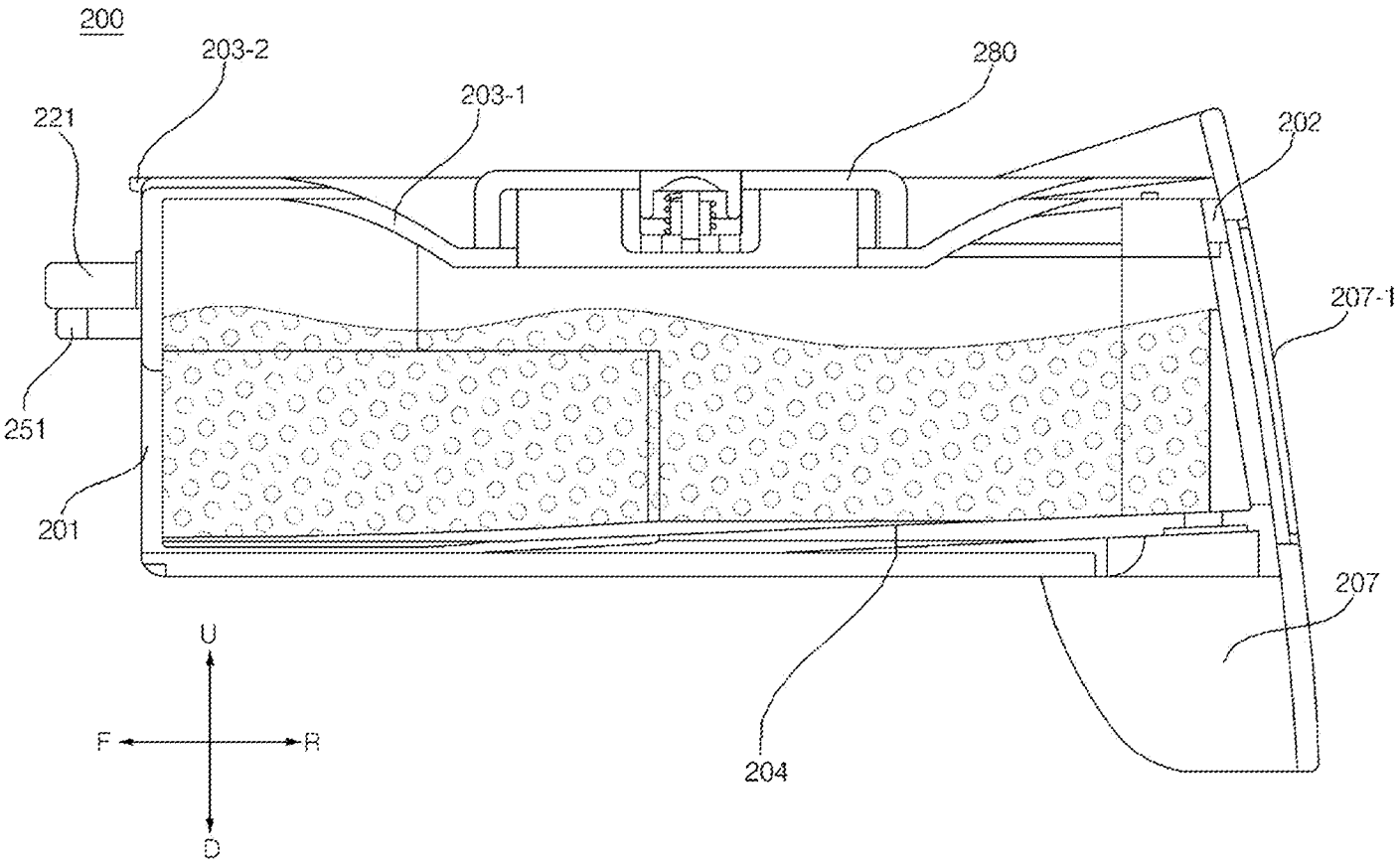
FIG. 12 is a cross-sectional view along line C-C' of FIG. 10.

The water level window 207-1 may be provided to allow light emitted from the light source 160 to be discharged to the outside of the body 10 therethrough, and to allow a user to check a level of water stored in the water tank 200. Referring to FIGS. 12 and 13, the water level window 207-1 may be provided as a hole is formed in the water tank cover 207. The hole formed in the water tank cover 207 may have a plurality of layers having different lengths in the upward-downward direction. The hole formed in the water tank cover 207 may include a portion which protrudes a predetermined length from an outer surface of the water tank cover 207 toward the center of the hole. The hole formed in the water tank cover 207 may be formed such that a cross sectional area of the hole in the outer surface of the water tank cover 207 is smaller than a cross sectional area of the hole in the inner surface of the water tank cover 207.

Referring to FIG. 12, the water level window 207-1 may be provided with at least part of the rear wall protrusion 202-1 that may being inserted into the hole formed in the water tank cover 207. The water level window 207-1 may be provided with at least part of the rear wall protrusion 202-1 being exposed to the outside of the body 10.

At least part of the rear wall protrusion being exposed to the outside of the body 10 through the water level window 207-1 may be formed of a transparent material. At least part of the rear wall protrusion being exposed to the outside of the body 10 through the water level window 207-1 may be transparent. At least part of the rear wall protrusion 202-1 being exposed to the outside of the body 10 through the water level window 207-1 may have a color. At least part of the rear wall protrusion 202-1 being exposed to the outside of the body 10 through the water level window 207-1 may have a pattern.

At least part of the rear wall protrusion 202-1 being exposed to the outside of the body 10 through the water level window 207-1 may be formed of a material different from that of the rear wall 202. The water level window 207-1 may be provided with a transparent member being inserted into the hole formed in the water tank 207. The transparent member may be transparent. The transparent member may have a color. The transparent member may have a pattern. The water level window 207-1 may cover at least part of the rear wall protrusion 202-1. The water level window 207-1 may be provided to allow a user to see at least part of the rear wall protrusion 202-1.

The water tank 200 may include a water tank water pipe 210 which serves as a path along which water is discharged from the water tank 200. The water tank water pipe 210 may provide a path along which water is discharged from the water tank 200 by the water supply pump 30.

Figure 8:
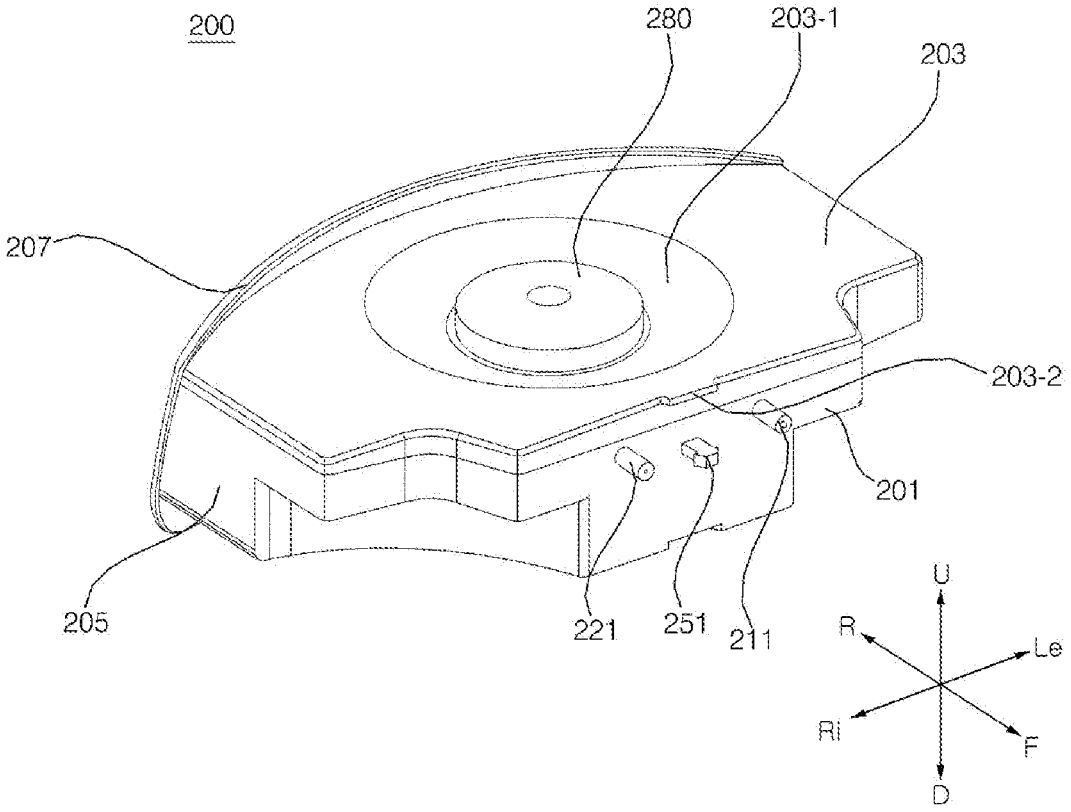
FIG. 8 is a perspective view, as seen from above, of the water tank of FIG. 1.

Referring to FIGS. 7, 8, and 13, the robot cleaner 1 may include the exterior water pipe 211 positioned in the water tank 200 and serving as a path along which water is discharged from the water tank 200. The exterior water pipe 211 may protrude from the outer surface of the water tank 200 in a direction in which the water tank 200 is inserted.

The water tank water pipe 210 may include the exterior water pipe 211 which protrudes from the outer surface of the water tank 200 in a direction in which the water tank 200 is inserted. The exterior water pipe 211 may be positioned closer to the upper side of the water tank 200 than the lower side of the water tank 200. The robot cleaner 1 may include the interior water pipe 212 having one end which is connected to the exterior water pipe 211. The other end of the interior water pipe 212 may be positioned closer to the top of the water tank 200 than the bottom of the water tank 200. The interior water pipe 212 may be positioned in the water tank 200.

The exterior water pipe 211 may be in the shape of a pipe which protrudes from the outer surface of the water tank 200. The exterior water pipe 211 may protrude from the outer surface of the front wall 201. The exterior water pipe 211 may be positioned in the middle of the front wall 201. The exterior water pipe 211 may be in the shape which extends in a direction of movement of the water tank 200 to allow the exterior water pipe 211 to be coupled to the body 10 when the water tank 200 is inserted into the body 10.

The exterior water pipe 211 may form a path along which water is discharged from the water tank 200. The exterior water tank 211 may guide a path along which water is discharged from the water tank 200 by the water supply pump 30.

When coupled to the water pipe coupler 110 when the water tank 200 is inserted into the body 10, the exterior water pipe 211 may guide water to flow from the water tank 200 into the body 10. When coupled to the water pipe coupler 110 when the water tank 200 is inserted into the body 10, the exterior water pipe 211 may provide a force to couple the water tank 200 and the body 10 to each other.

The exterior water pipe 211 may be shaped such that the outer circumference of the exterior water pipe 211 has a diameter greater than a cross-sectional area of a hole formed by the gasket of the water pipe coupler 110, and therefore, the exterior water pipe 211 and the water pipe coupler 110 may be coupled to each other as the water tank 200 is inserted into the body 10.

The exterior water pipe 211 configured as above may make a flow path to be sealed once the water tank 200 is coupled to the body 10. When coupled to the water pipe coupler 110 having a plurality of gaskets, the exterior water pipe 211 may seal the water tank 200 more tightly to prevent a leakage of water. When the exterior water pipe 211 and the water pipe coupler 110 are coupled to each other, a force to couple the water tank 200 and the body 10 to each other may be provided.

Referring to FIGS. 7 and 13, the interior water pipe 212 may be positioned in the water tank 200. One end of the interior water pipe 212 may be connected to the exterior water pipe 211. The upper end of the interior water pipe 212 may be connected to the exterior water pipe 211. The other end of the interior water pipe 212 may be positioned closer to the lower side of the water tank 200 than the upper side of the water tank 200. The lower end of the interior water pipe 212 may be positioned closer to the lower wall 204 than the upper wall 203.

At least part of the lower end of the interior water pipe 212 may be capable of being decoupled from the lower wall 204. The lower end of the interior water pipe 212 may be capable of being decoupled from the lower wall 204, whereas a portion of the interior water pipe 212 in contact with the front wall 201 may be capable of contacting the lower wall 204.

The interior water pipe 212 may in the shape having a predetermined length in the upward-downward direction. The interior water pipe 212 may be in the shape extending in the upward-downward direction. The interior water pipe 212 may be in the shape extending at a predetermined angle relative to the upward-downward direction.

The interior water pipe 212 may be formed with a flow path of which a cross-sectional area at the upper end is different from a cross-sectional area at the lower end. The interior water pipe 212 may be in the shape of a pipe extending downward along one sidewall of the water tank 200. The interior water pipe 212 may be shaped such that one sidewall of the water tank 200 constitutes a part of a pipe.

The interior water pipe 212 may protrude from one sidewall of the water tank 200. The interior water pipe 212 may be in the shape of a pipe adjacent to one sidewall of the water tank 200. The interior water pipe 212 may protrude from the front wall 201. The interior water pipe 212 may be in the shape of a pipe which extend along the front wall 201 in the upward-downward direction. The interior water pipe 212 may be connected to the exterior water pipe 211 on an outer surface of the front wall.

When the water tank pipe 210 is configured as above, a hole which penetrates the water tank 200 to discharge water may be formed adjacent to the upper wall 203, thereby preventing a leakage of water caused by the weight of the water. The water tank pipe 210 may be configured to make water stored in the lower side of the water tank 200 to flow upward through the interior water pipe 212, so that water can be efficiently discharged by hydraulic pressure when the water are absorbed using the water supply pump 30.

At one of the body 10 or the water tank 300, there may be the air pipe 221 protruding toward the other. At the other of the body 10 or the water tank 300, there may be the air pipe gasket 120 surrounding the outer circumference of one end of the air pipe 221 with the water tank 200 being inserted into the body 10. In this embodiment, the water tank 200 includes an air pipe 221 which protrudes toward the body 10, and a water tank insertion part 100 includes the air pipe gasket 120. However, the water tank insertion part 100 may include a water pipe 221 protruding toward the water tank 200.

Referring to FIGS. 8 and 12, the water tank 200 may include a water tank air pipe 221 which penetrates the water tank 200. The water tank 221 may be in the shape of a pipe which protrudes from an outer surface of the water tank 200. The water tank air pipe 221 may protrude toward the body 10. The water tank air pipe 221 may protrude forward from an outer surface of the front wall 201.

The water tank air pipe 221 may extend in a direction of movement of the water tank 200, so that the water tank air pipe 221 is coupled to the body 10 as the water tank 200 is inserted into the body 10. With the water tank 200 being inserted into the body 10, the water tank air pipe 221 may be coupled to the air pipe gasket 120. The water tank air pipe 221 may be coupled to the air pipe gasket 120 that surrounds the outer circumference of one end of the air pipe 221.

The water tank air pipe 221 may form a hole, which communicates the inside and the outside of the water tank 200, so as to form a path along which air flows. The water tank air pipe 221 may form a path along which air flows into or is discharged from the water tank 200.

The water tank air pipe 221 may be positioned in the middle of the front wall 201. The water tank air pipe 221 may be positioned to be vertically symmetric to the exterior water pipe 211 in the middle of the front wall 201. The water tank air pipe 221 may protrudes a length as the same as the protruding length of the exterior water pipe 211. The water tank air pipe 221 may prevent the inside of the water tank 200 from forming vacuum, so that water can efficiently flow into the body 10 along a water pipe.

With the water tank 200 being inserted into the body 10, the water tank air pipe 221 may be coupled to the air pipe gasket 120. As being coupled to the air pipe gasket 120 when the water tank 200 is inserted into the body 10, the water tank air pipe 221 may provide a force to couple the water tank 200 and the body 10 to each other. The water tank air pipe 221 may be formed such that a diameter of the outer circumference is greater than a cross-sectional area of a hole formed by the air pipe gasket 120, and thus, a coupling force between the water tank air pipe 221 and the air pipe gasket 120 may be enhanced when the water tank 200 is inserted into the body 10.

When coupled to the air pipe gasket 120, the water tank air pipe 221 may allow air to flow into or be discharged from the water tank 200 due to difference in air pressure between the inside and the outside of the water tank 200. When water is discharged from the water tank 200 upon operation of the water supply pump 30 and thereby air pressure in the water tank 200 is reduced, air may flow into the water tank 200 through the air tank air pipe 221. Due to difference in air pressure between the inside and the outside of the water tank 200, air may pass through an elastic gasket and the water tank air pipe 221 to thereby flow into the water tank 200 through the water tank air pipe 221.

Figure 9:
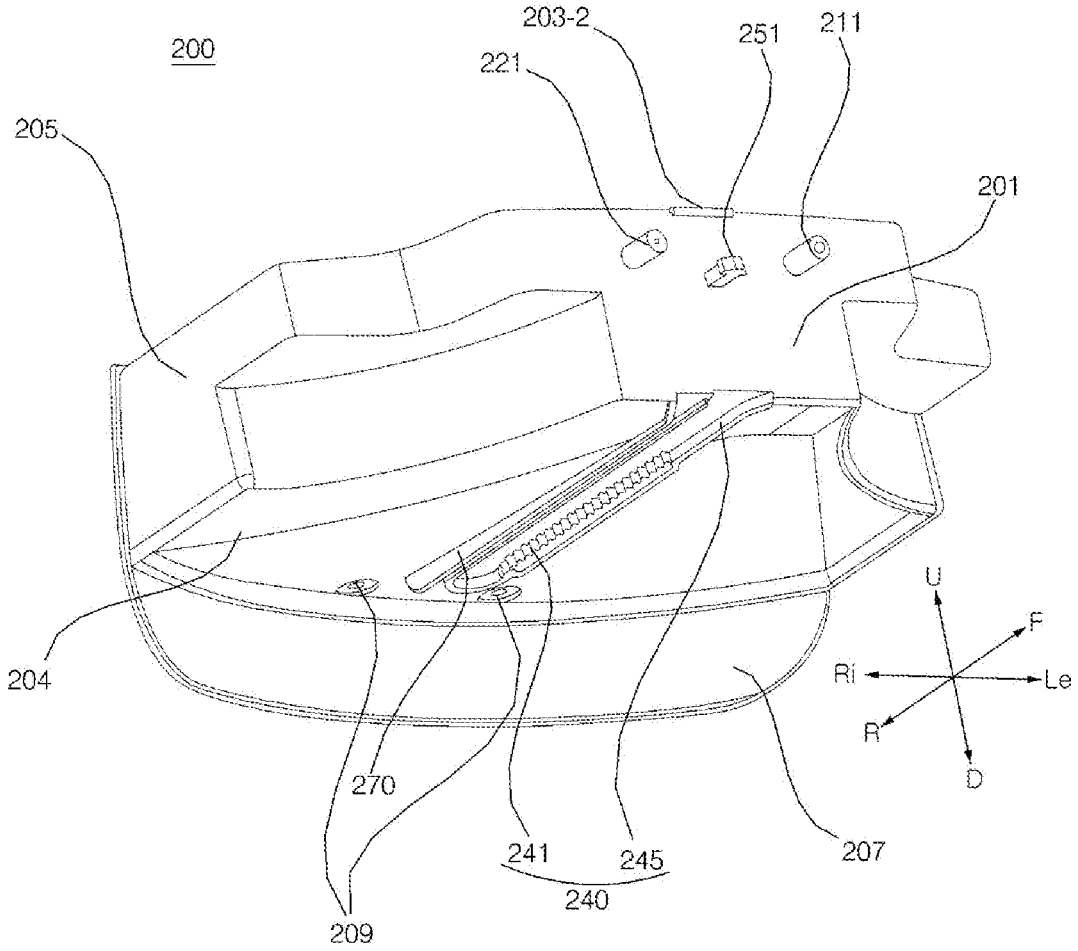
FIG. 9 is a perspective view, as seen from below, of the water tank of FIG. 8.
Figure 10:
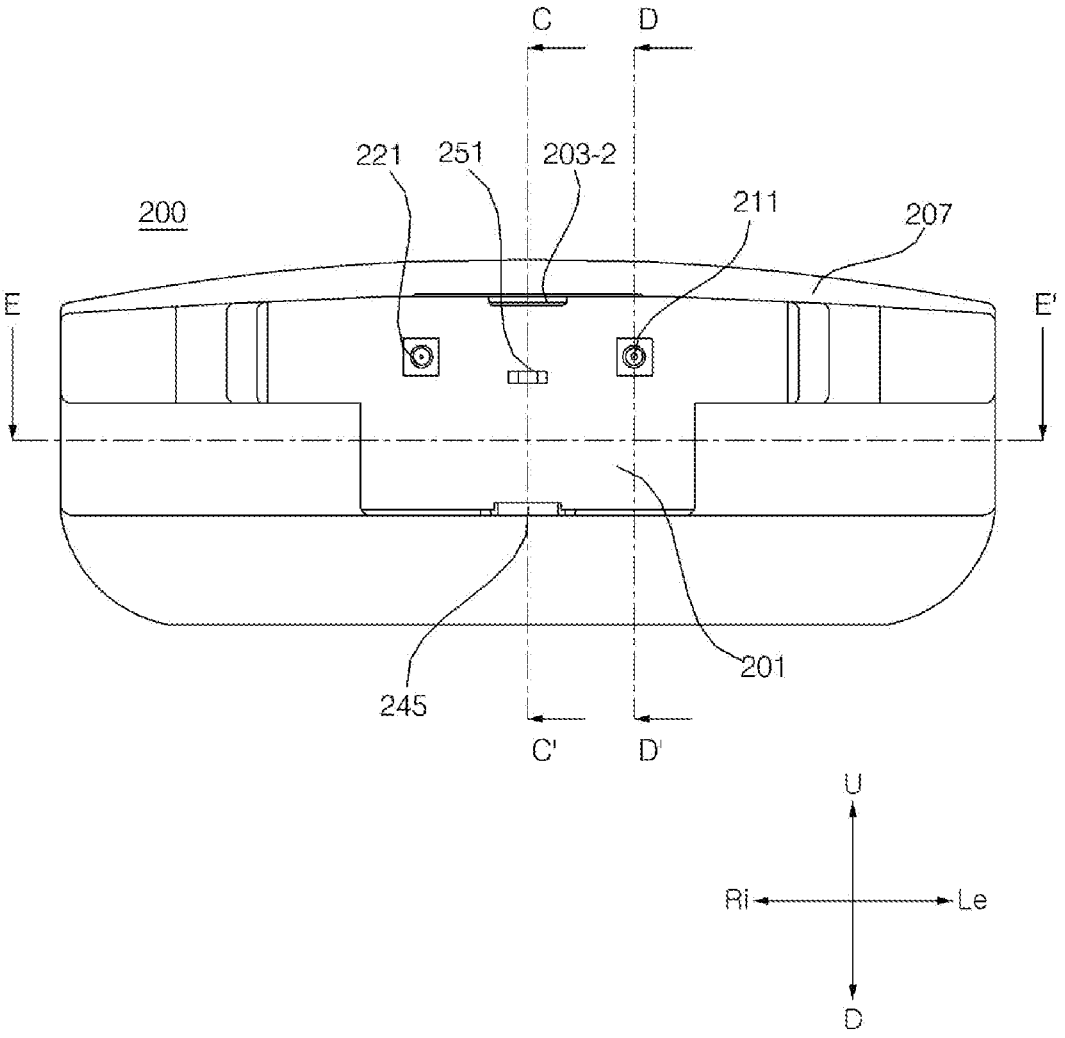
FIG. 10 is a front view of the water tank of FIG. 9.
Figure 11:
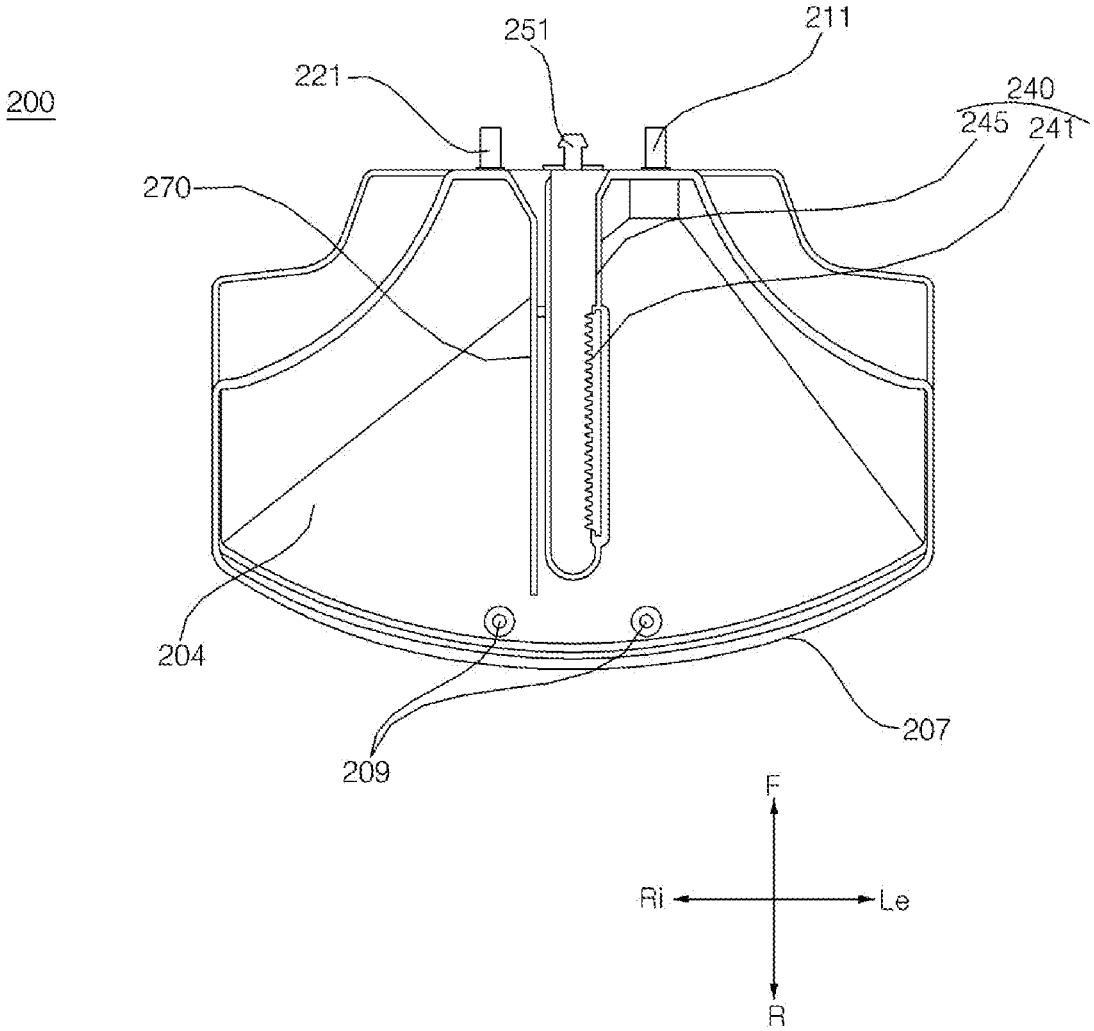
FIG. 11 is a bottom view of the water tank of FIG. 8.

Referring to FIGS. 9 and 11, the water tank 200 may include a water tank damping part 240. Along with the body damping part 140 provided in the body 10, the water tank damping part 240 may provide a resistance force to the water tank 200 when the water tank 200 moves.

The robot cleaner 1 may include a rack 241 positioned on an outer surface of the water tank 200. The robot cleaner 1 may include one or more pinions 141 which are positioned to be engaged with the rack 241 to rotate. The one or more pinions 141 may be positioned in the body 10. The robot cleaner 1 may include a damper 143 which is axially connected to any one of the one or more pinions 141. The damper 143 may provide a resistance force when a pinion 141 connected to the damper 143 rotates.

The water tank damping part 240 may provide a resistance force to the water tank 200 when the water tank 200 moves. The water tank damping part 240 may make the water tank 200 to move at a predetermined speed or less. The water tank damping part 240 may make the water tank 200 to move at a predetermined acceleration rate or less.

The water tank damping part 240 may prevent the water tank 200 from moving abruptly. The water tank damping part 240 may suppress water stored in the water tank 200 from flowing. The water tank damping part 240 may suppress the water tank 200 from vibrating because of water flow. The water tank damping part 240 may prevent a leakage of the water stored in the water tank 200.

The water tank damping part 240 may prevent the water tank 200 from being detached from the body 10 and thereby falling down due to inertial force when the water tank 200 is withdrawn from the body 10. When the elastic force provider 130 provides an elastic force in a direction in which the water tank 200 is withdrawn, the water tank damping part 240 may provide a resistance force to the water tank 200 so as to keep the forces applied to the water tank 200 in balance.

Referring to FIGS. 9 and 11, the water tank damping part 240 may include a rack 241. The rack 241 may be positioned on an outer surface of the water tank 200. The rack 241 may be positioned on an outer surface of the lower wall 204. The rack 241 may be formed with a predetermined length in a direction of movement of the water tank 200. The rack 241 may be formed with a predetermined length in the front-rear direction.

The rack 241 may have a length long enough to be engaged with a pinion 141 when the water tank 200 is inserted a predetermined length into the body 10. The rack 241 may have a length long enough to make the water tank 200 to experience a resistance force in a predetermined distance when the water tank 200 is inserted into the body 10.

The rack 241 may be positioned to be engaged with the pinion 141. Being engaged with the pinion, the rack 241 may convert linear movement of the water tank 200 into rotation movement of the pinion 141. The rack 241 may be formed with a predetermined thickness to correspond to a thickness of the pinion 141.

The rack 241 may be an additional member positioned separate from the water tank 200. The rack 241 may be integrally formed with the water tank 200. The rack 241 may be positioned in contact with one side of the damping guide 245. The rack 241 may be positioned in the middle of the left protruding line of the damping guide 245.

The rack 241 may be coupled to the water tank 200 as the front end of the rack 241 is inserted into a groove formed forward of the damping guide 245. The rack 241 may be coupled to the water tank 200 as the rear end of the rack 241 is inserted into a groove formed rearward of the damping guide 245.

Referring to FIGS. 9 and 11, the water tank damping part 240 may include the damping guide 245. The damping guide 245 may be positioned on an outer surface of the water tank 200 on which the rack 241 is positioned. The damping guide 245 may be positioned on an outer surface of the lower wall 204. The damping guide 245 may be formed with a predetermined length in a direction of movement of the water tank 200. The damping guide 245 may be formed with a predetermined length in the front-rear direction.

The damping guide 245 may include one or more protruding line which protrude downward of the water tank 200 from the lower wall 204. The damping guide 245 may be a groove which is recessed inward of the water tank 200 from the lower wall 204.

The damping guide 245 may include left and right protruding lines which extend in the front-rear direction. The damping guide 245 may be protruding lines which extend from the rear end of the damping guide 245 in the front-rear direction. The rear end of the damping guide 245 may be in the form of a semi-circular hook at which the left and right protruding lines are connected to each other.

The damping guide 245 may extend rearward from the front wall 201. As the front end of the damping guide 245 being connected to the front wall 201 is bent outward in the left-right direction of the water tank 200, it is possible to effectively guide the pinion 141 to move into the damping guide 245.

The damping guide 245 may include a groove which is recessed inward of the water tank 200. The front end of the left protruding line of the damping guide 245 may be extend to a side (e.g., to the left), so that an entrance through which the pinion 141 is inserted is open wider. The damping guide 245 may guide a movement of the water tank 200. Along with the water tank guide 270, the damping guide 245 may guide the movement of the water tank 200.

The right protruding line of the damping guide 245 may be positioned to come into contact with the lower body guide 174 provided in the body 10. Between the water tank guide 270 and the right protruding line of the damping guide 245, there may be a space into which the lower body guide 174 is inserted.

The water tank 200 may include the latch protrusion 251 which makes up a latch part along with the latch groove 151 provided in the body 10. The latch protrusion 251 may be positioned on one side of the water tank 200. Referring to FIG. 8, the latch protrusion 251 may extend in a direction of movement of the water tank 200. The latch protrusion 251 may extend in a horizontal direction.

The latch protrusion 251 may protrude from an outer surface of the water tank 200. The latch protrusion 251 may protrude from an outer surface of the front wall 201. The latch protrusion 251 may protrude forward from the front wall 201. The latch protrusion 251 may be formed in the middle of the front wall 201. The latch protrusion 251 may protrude so that at least part of the latch protrusion 251 is inserted into the latch groove 151.

A protruding portion may be formed at the end of the latch protrusion 251. The latch protrusion 251 may have two protruding portions formed on both sides of its end. The latch protrusion 251 may include left and right protruding portions formed in its end. The latch protrusion 251 may have projections so as to be inserted into the latch groove 151 and coupled thereto. As being coupled to the latch groove 151, the latch protrusion 251 may provide a force to couple the water tank 200 and the body 10 to each other.

The latch protrusion 251 may make up a latch part along with the latch groove 151 provided in the body 10. The latch part may make the water tank 200 and the body 10 coupled to or decoupled from each other upon push of the water tank 200 in a direction in which the water tank 200 is inserted. The latch groove 151 may be configured to remain coupled to the latch protrusion 251 when pushed once, and to be decoupled from the latch protrusion 251 when pushed twice.

As being coupled to the latch groove 151, the latch protrusion 251 may help the water tank 200 to stop at a predetermined location. The latch protrusion 251 may be positioned to be coupled to the latch groove 151. The latch protrusion 251 may be positioned between the exterior water pipe 211 and the air pipe 221 provided on the front wall 201. The latch protrusion 251 may be positioned closer to the top surface of the water tank 200 than the bottom surface of the water tank 200 so that the water tank 200 and the body 10 may be coupled to each other stably.

The water tank 200 may include a water tank guide 270 which guides the water tank 200 to move. Referring to FIGS. 9 and 11, the water tank guide 270 may be provided on an outer surface of the water tank 200. The water tank guide 270 may be provided on an outer surface of the lower wall 204.

The water tank guide 270 may include a protruding line which protrudes downward of the water tank 200 from the lower wall 204. The water tank guide 270 may include a groove which is recessed inward of the water tank 200 in the lower wall 204.

The water tank guide 270 may be formed in a predetermined length in the front-rear direction. As the front end of the water tank guide 270 being connected to the front wall 201 is bent outward in the left-right direction of the water tank 200, the water tank guide 270 may be able to guide the lower body guide 174 efficiently.

The water tank guide 270 may be formed to come into contact with one surface of the water tank insertion part 100. The water tank guide 270 may be formed to come into contact with the bottom surface of the water tank insertion part 100. The water tank guide 270 may protrude at a height high enough to contact the bottom surface of the water tank insertion part 100.

When the water tank 200 is inserted into the body 10, the water tank guide 270 may guide the water tank 200 to move. The lower body guide 270 may be inserted into a space formed between the water tank guide 270 and the right protruding line of the damping guide 245, and the water tank guide 270 may guide the water tank 200 to move. The water tank guide 270 may be positioned so that the space formed between the water tank guide 270 and the right protruding line of the damping guide 245 corresponds to a thickness of the lower body guide 174.

Figure 15:
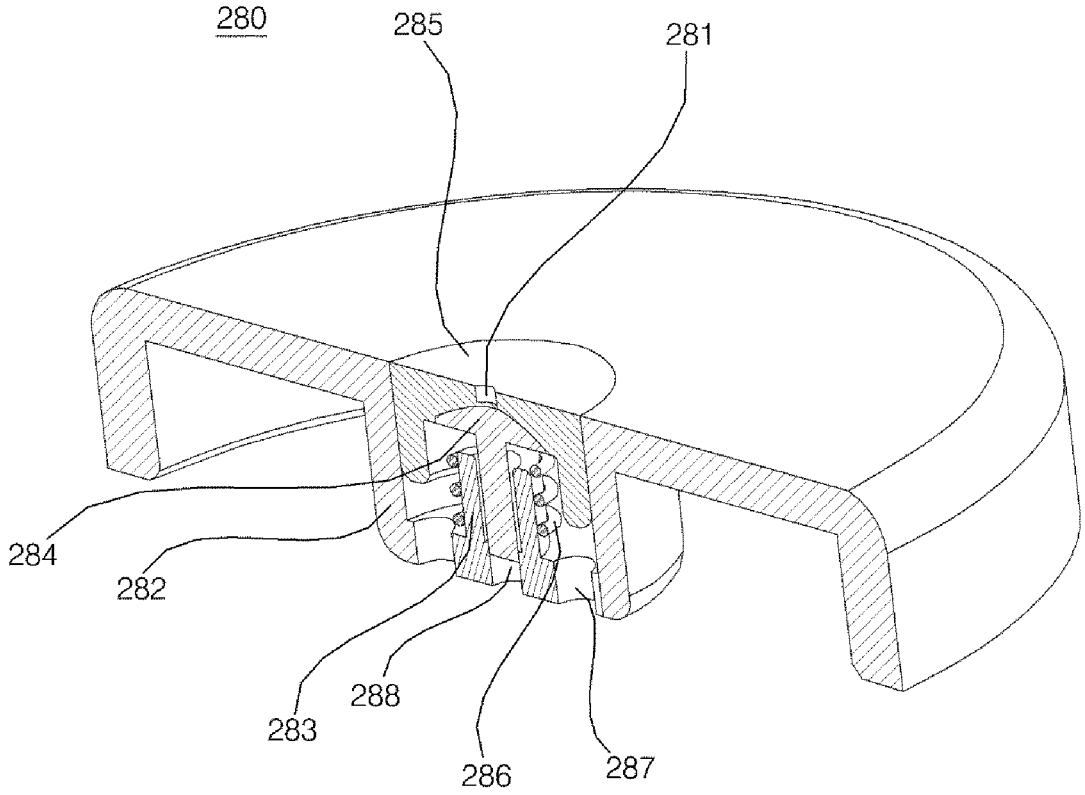
FIG. 15 is a cross-sectional view of a water tank cap for the water tank of FIG. 8.

Referring to FIGS. 8 and 15, the water tank 200 may include a water tank cap 280 by which a water supply hole formed in the upper side of the water tank 200 is opened and closed. The water tank cap 280 may include a cap air hole 281. The water tank cap 280 may include a cap lead 284 which controls the opening and closing of the cap air hole 281 based on a difference in air pressure between the inside and the outside of the water tank 200. The water tank cap 280 may include a cap elastic element 286 which provides an elastic force to the cap lead 284.

The water tank cap 280 may be in the shape of a circular plate having an edge bent vertical to a top surface and extending. The extending portion bent from the edge of the circular plate may define the height of the water tank cap 280. The water tank cap 280 may be formed such that a circular-shaped upper plate and a circumferential plate are connected to each other at a rounded outer edge. The water tank cap 280 may open and close a water supply hole through which water can be injected. As having an elastic body inside, the water tank cap 280 may seal the water tank 200 more tightly.

Figure 16:
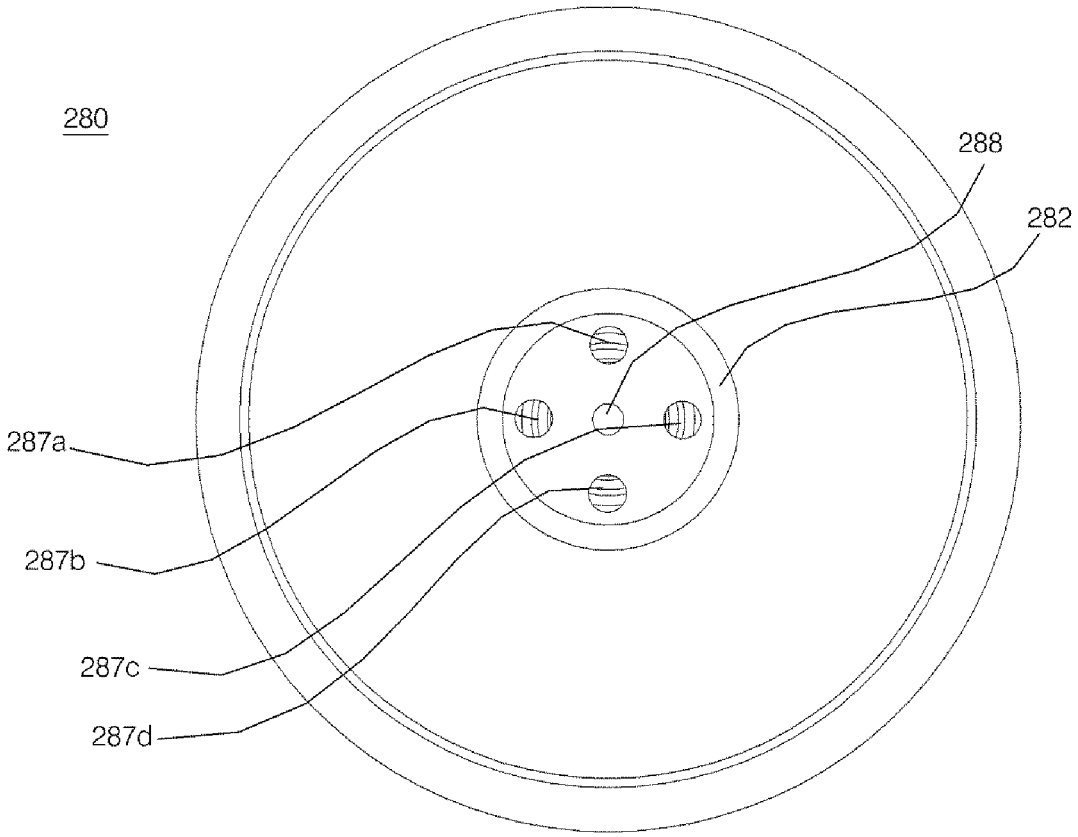
FIG. 16 is a rear view of a water tank cap for the water tank of FIG. 8.

Referring to FIGS. 15 and 16, the water tank cap 280 may include the cap air hole 281 though which air can pass. The water tank cap 280 may include the cap air hole 281 which protrudes downward from the bottom surface of the upper plate of the water tank cap 280. The cap air hole 281 may be a hole which is formed at the center of the water tank cap 280 to penetrate the water tank cap 280.

With the water tank cap 280 being coupled to the water tank 200, the cap air hole 281 may allow air to flow into the water tank 200. With the water tank cap 280 being coupled to the water tank 200, the cap air hole 281 may allow air to be discharged from the water tank 200. When sound pressure occurs inside the water tank 200 due to operation of the water supply pump 30, the cap air hole 281 may allow air to flow into the water tank 200 therethrough.

Referring to FIGS. 15 and 16, the water tank cap 280 may include a cap main pillar 282. The cap main pillar 282 may protrude downward from the upper plate of the water tank cap 280. The cap main pillar 282 may protrude downward from the center of the upper plate of the water tank cap 280. The cap main pillar 282 may be in a protruding shape, such as a cylinder.

The cap main pillar 282 may be in a protruding shape having a hole formed therein. The cap main pillar 282 may be open at the top. The cap main pillar 282 may be in the shape including a cap sub-pillar 283 which protrudes inward of the water tank cap 280 from a wall positioned at the bottom of the cap main pillar 282. The cap sub-pillar 283 may be in the shape protruding upward from a wall at the bottom of the cap main pillar 282.

One or more holes may be formed in the wall at the bottom of the cap main pillar 282. A cap lower air hole 287 through which air can pass may be formed at the bottom of the cap main pillar 282. A plurality of lower air holes 287 may be arranged in the left-right direction of the cap main pillar 282. A cap lead movement hole 288 through which the cap lead 284 can move may be formed in the cap main pillar 282. The cap lead movement hole 288 may be formed at the center of the bottom surface of the cap main pillar 282.

An open hole formed in the upper side of the cap main pillar 282 may be covered by a cap closure 282. The cap main pillar 282 may accommodate the cap lead 284 using which the air hope 281 can be opened and closed. The cap main pillar 282 may accommodate the cap elastic element 286 which provides an elastic force to the cap lead 284.

Referring to FIG. 15, the cap sub-pillar 283 may be in the shape protruding upward from a wall formed at the bottom of the cap main pillar 282. The cap sub-pillar 283 may be in the shape of a cylinder having a diameter which is smaller than a diameter of a cylindrical-shaped cap main pillar 282. The cap sub-pillar 283 may be in the shape of a cylinder having a vertical length shorter than a vertical length of a cylindrical-shaped cap main pillar 282.

The cap sub-pillar 283 may have a hole formed at the center thereof. The cap lead 284 may be inserted into the hole formed at the center of the cap sub-pillar 283. With the cap lead 284 being inserted into the hole, the cap sub-pillar 283 may be able to move.

Referring to FIG. 15, the cap lead 284 may be in the shape of a stick which is formed with a predetermined length. The cap lead 284 may be in the shape which includes a cylindrical stick formed with a predetermined length. The cap lead 284 may have a head portion which is formed at one end of the stick and protrudes greater than a cross-sectional area of the stick in a thickness direction of the stick. The cap lead 284 may have a head portion which is formed at one end of a stick extending in the upward-downward direction and protrudes further in the horizontal direction.

The cap lead 284 may have a head portion, and whose lower side is connected to a stick and whose upper side is convex upward. The stick of the cap lead 284 may be inserted into the hole formed in the cap sub-pillar 283. The stick of the cap lead 284 may be inserted into the hole formed in the cap sub-pillar 283 and move in the upward-downward direction.

The cap lead 284 may be positioned to open and close the cap air hole 281 formed in the cap closure 285. The head portion of the cap lead 284 may be positioned to come into contact with the cap closure 285. The cap lead 284 may be accommodated inside the cap main pillar 282. As the head portion comes into contact with the cap closure 285, the cap lead 284 may close the cap air hole 281. As the head portion is separate from the cap closure 285, the cap lead 284 may open the cap air hole 281.

Referring to FIG. 15, the cap closure 285 may cover an open end of the cap main pillar 282. The cap closure 285 may be shaped to be inserted into an inner surface of an open hole formed in the cap main pillar 282 and coupled to the cap main pillar 282. The cap closure 285 may be wholly in the shape of a cylinder. The cap closure 285 may have an air hole formed at the center thereof.

The top of the cap closure 285 may be connected to the top surface of the water tank cap 280. The cap closure 285 may be positioned such that the circumferential surface thereof comes into contact with the inner surface of the cap main pillar 282. The circumferential surface of the cap closure 285 may extend downward further than a surface where the cap closure 285 contacts the cap lead 284.

The cap closure 285 may be positioned to contact the cap lead 284 from below. The cap closure 285 may be formed such that the head portion of the cap lead 284 can be placed in the cap closure 285. The cap closure 285 may include a contact surface formed inside, the contact surface which corresponds a convex surface of the head portion of the cap lead 284 so that the cap lead 284 can be placed in the cap closure 285.

Referring to FIG. 15, the cap elastic element 286 may provide a force to the cap lead 284 to push the cap closure 285. The cap elastic element 286 may provide a force to the cap lead 284 to push upward. The cap elastic element 286 may provide an elastic force to allow the cap lead 284 to come into contact with the cap closure 285. The cap elastic element 286 may be provided as a cap coil spring.

One end of the cap elastic element 286 may come into contact with the cap lead 284. The cap elastic element 286 may be supported as the other end thereof is in contact with a surface at the bottom of the cap main pillar 282. The cap elastic element 286 may be accommodated in the cap main pillar 282.

The robot cleaner 1 as configured in the drawings may operate as described below. For example, the water tank 200 may be inserted into the body 10 and coupled thereto. The water tank 200 may be inserted into the water tank insertion part 100 which is formed open at one side of the body 10. At this point when being inserted into the body 10, the water tank 200 may be guided by a guide formed in the water tank 200.

Referring to FIG. 17, when the water tank 200 is inserted a predetermined depth into the body 10, the water tank 200 may come into contact with the moving bar 131 and receive from the elastic force provider 130 an elastic force that pushes the water tank 200 in a direction opposite to a direction in which the water tank 200 is inserted.

As the water tank 200 is inserted, the moving bar 131 moves inward of the body 10, and thus, the elastic element 135 connected to the moving bar 131 may be deformed. The elastic element 135 may generate a constant elastic force, regardless of an amount of deformation of the elastic member 135. Due to the elastic force provided to the water tank 200, a user may experience resistance when inserting the water tank 200 into the body 10.

Simultaneously or independently, the water tank 200 may come into contact with the body damping part 140. When the water tank 200 is inserted the predetermined depth into the body 10, the rack 241 in the water tank 200 may be engaged with the pinion 141 in the body 10 to enable the pinion 141 to rotate. In this manner, linear movement of the water tank 200 may be converted into rotation movement of the pinion 141.

The pinion 141 may be a plurality of pinions 141. In this case, the plurality of pinions 141 may include a first pinion which is engaged with the rack 241 to rotate, and a second pinion which is connected to the first pinion and axially connected to the damper 143. When the second pinion axially connected to the damper 143 rotates, the damper 143 may provide a resistance force in a direction opposite to a direction of rotation of the second pinion.

When the resistance force is provided to the second pinion connected to the damper 143, resistance may be provided to the rack 241 through the first pinion and thus the water tank 200 may experience a resistance force when moving. Due to the resistance force provided to the water tank 200, a user may experience resistance when inserting the water tank 200 into the body 10. In this manner, the damping part 140 and 240 may prevent the water tank 200 from moving abruptly and may cause the user to feel a sense of operation.

The damping part 140 and 240 may suppress water stored in the water tank 200 from flowing, thereby suppressing the water tank 200 from vibrating because of water flow in the robot cleaner 1 when the water tank 200 is inserted in the robot cleaner 1. The damping part 140 and 240 may suppress water stored in the water tank 200 from flowing, thereby preventing the water from leaking through a hole, such as an air hole formed in the water tank 200.

After contacting the elastic force provider 130 and the body damping part 140, the water tank 200 may keep being inserted into the body 10. When the front water tank fall 201 of the water tank 200 approaches the inner sidewall of the water tank insertion part 100 within a predetermined distance, the exterior water pipe 211 provided in the front wall 201 may come into contact with the water tank coupler 110 provided in the body 10.

The exterior water pipe 211 may be inserted into a gasket provided in the coupler 110 and coupled to the coupler 110. At the same time, the exterior water pipe 211 may be sealed and form a flow path along which water flows into the body 10 from the water tank 200. The exterior water pipe 211 may be inserted into a plurality of gaskets provided in the water pipe coupler 110, sequentially, may be coupled to the water pipe coupler 110, and may provide a coupling force to the water tank 200 and the body 10.

Once the exterior water pipe 211 is coupled to the water pipe coupler 110, the air pipe 221 provided in the water tank 200 and the air pipe gasket 120 provided in the body 10 may be coupled to each other. The air pipe 221 may be inserted into the air pipe gasket 120 and coupled thereto. As being coupled to each other, the air pipe 221 and the air pipe gasket 120 may allow air to flow after passing through the air pipe 221 due to air pressure inside the water tank 200.

When water is discharged from the water tank 200 upon operation of the water supply pump 30 and thereby air pressure inside the water tank 200 is reduced, the air pipe 221 and the air pipe gasket 120 may allow air to flow into the water tank 200 through the air pipe 221.

The air pipe 221 and the air pipe gasket 120 may allow air to pass through between an elastic gasket and the air pipe 221 due to difference in air pressure between the inside and the outside of the water tank 200 to thereby flow into the water tank 200 through the air pipe 221.

If the water tank 200 is inserted further inward of the body 10, the latch protrusion 251 provided in the water tank 200 may come into contact with the latch groove 151 provided in the body 10. The latch protrusion 251 may be inserted into the latch groove 151 and coupled thereto. As projections formed in the latch protrusion 251 are engaged with projections formed in the latch groove 151, the latch protrusion 251 may be coupled to the latch groove 151.

The latch protrusion 251 and the latch groove 151 may make up a latch part. The latch part may be configured such that the latch groove 151 remains coupled to the latch protrusion 251 when pushed once, whereas the latch groove 151 is decoupled from the latch protrusion 251 when pushed twice.

The latch part may make the water tank 200 and the body 10 coupled to each other. The latch part may include a sensor for detecting connection between the water tank 200 and the body 10. The latch part may include a switch for turning on the light source 160 when the latch protrusion 251 and the latch groove 151 are coupled to each other.

If the water tank 200 and the body 10 are coupled to each other as the latch protrusion 251 and the latch groove 151 are coupled to each other, the light source 160 provided in the body 10 may be turned on and emit light toward the water tank 200.

The light source 160 may be preset to allow emitted light to pass through the water tank 200 and be then discharged to the outside of the body 10. The light source 160 may be positioned to face the front wall 201 so as to emit light toward the water tank 200. The light emitted from the light source 160 may pass through the water tank 200 and be then emitted to the outside of the body 10 through the rear wall protrusion 202-1 provided in the rear wall 202 and the water level window 207-1 provided in the water tank cover 207.

With the light discharged through the water level window 207-1, the user may confirm that the water tank 200 and the body 10 are coupled to each other. In addition, the user may be able to see a level of water stored in the water tank 200 with bear eyes through the water level window 207-1.

Next, following is description about how the water tank 200 is separated from the body 10. If a user pushes the water tank 200 from the outside of the body 10 while the water tank 200 is coupled to the body 10, the latch protrusion 251 and the latch groove 151 may be decoupled from each other.

The elastic force applied by the elastic force provider 130 toward a direction in which the water tank 200 is withdrawn may be greater than a sum of a resistance force provided by the damping part 140 and 240 to the water tank 200, a coupling force between the exterior water pipe 211 and the water pipe coupler 110, a coupling force between the air pipe 221 and the air pipe gasket 120, and a force applied to the water tank 200 toward a direction in which the water tank 200 is inserted.

When the latch protrusion 251 and the latch groove 151 are decoupled from each other, the water tank 200 may be automatically withdrawn outward by the elastic force provided by the elastic force provider 130 to the water tank 200. The water tank 200 may be withdrawn outward of the body 10, and even the moving bar 131 may move with remaining in contact with the water tank 200.

The elastic element 135 of the elastic force provider 130 may be positioned to be deformed upon movement of the moving bar 131, and may provide a constant elastic force to the moving bar 131, regardless of an amount of deformation of the elastic element 135. While the water tank 200 is withdrawn, the elastic force provider 130 may provide the constant elastic force to the water tank 200.

When the water tank 200 moves, a pinion 141 provided in the body 10 may rotate as being engaged with the rack 241 provided in the water tank 200. In this manner, linear movement of the water tank 200 may be converted into rotation movement of the pinion 141. The pinion 141 may be a plurality of pinions 141. In this case, the plurality of pinions 141 may include a first pinion which is engaged with the rack 241 to rotate, and a second pinion which is connected to the first pinion and axially connected to the damper 143.

When the second pinion axially connected to the damper 143 rotates, the damper 143 may provide a resistance force in a direction opposite to a direction of rotation of the second pinion. In this manner, the damping part 140 and 240 may prevent the water tank 200 from moving abruptly, and may cause the user to feel a sense of operation.

When the water tank 200 is withdrawn a predetermined distance from the body 10, the exterior water pipe 211 may be decoupled from the water pipe coupler 110. Simultaneously or independently, the air pipe 221 may be decoupled from the air pipe gasket 120.

The water tank 200 may receive an elastic force from the elastic force provider 130, and may be withdrawn the predetermined distance outward from the body 10. The robot cleaner 1 configured as above has an advantage that the water tank 200 is capable of being automatically withdrawn from the body 10 without an additional external force after a user pushes the water tank 200.

The robot cleaner 1 is configured to make the water tank 200 stop being withdrawn a predetermined distance outward from the body 10, and thus, the water tank 200 may be prevented from being completely decoupled from the body 10 to fall down. The robot cleaner 1 is configured to help a user to easily separate the water tank 200 from the robot cleaner 1.

The robot cleaner 1 may be configured as a one-touch sliding type, thereby improving a user's convenience. The robot cleaner 1 is semi-automatically and easily integrated with or separated by pushing the water tank 200, and thus, user convenience may improve. The robot cleaner 1 may have a structure in which a slide can be mounted in a horizontal direction, and thus, residual water is less likely to remain in the water tank 200.

The robot cleaner 1 has a structure in which an air hole formed in the water tank 200 is opened and closed due to difference in air pressure between the inside and the outside of the water tank 200 upon operation of the water tank 200, and thus, it is possible to prevent sound pressure from occurring inside the water tank 200, thereby helping water to be smoothly discharged from the water tank 200. The robot cleaner 1 has in a structure in which a discharge hole through which water is discharged from the water tank 200 is formed in the upper side of the water tank 200, and thus, it is possible to prevent residual water from being discharged due to self-weight of the water.

The robot cleaner 1 has a structure in which water stored in the lower side of the water tank 200 flows upward through the interior water pipe 212 to be discharged to the outside of the water tank 200, and thus, it is possible to efficiently discharge water due to hydraulic pressure when the water is absorbed by the water supply pump 30. The robot cleaner 1 is in a structure in which the water pipe coupler 110 is coupled to the exterior water pipe 211 to thereby seal the exterior water pipe 211, and thus, a water supply path may be sealed once the water tank 200 and the body 10 are coupled to each other.

One aspect of the present disclosure provides a robot cleaner which is in a structure that makes a user easy to check an amount of water stored in a water tank. Another aspect of the present disclosure provides a water tank in which residual water cannot remain and which is able to slide horizontally.

Yet another aspect of the present disclosure provides a water tank which prevents residual water caused by self-weight of water. Yet another aspect of the present disclosure prevents sound pressure from occurring inside a water tank when water stored in the water tank is pumped using a robot cleaner. Yet another aspects allows a water tank to be separate from a robot cleaner just by one touch without an additional force applied in a direction in which the water tank is withdrawn, thereby improving user convenience.

Another aspect prevents a water tank from abruptly moving when the water tank is inserted or withdrawn, thereby making residual water less likely to remain and improving a user's feeling of operation. Aspects of the present disclosure are not be limited to the aforementioned aspects, and other unmentioned aspects will be clearly understood by those skilled in the art from the present description.

In accordance with an embodiment of the present disclosure, the above and other aspects can be accomplished by a robot cleaner including: a body defining an exterior appearance of the robot cleaner; a cleaning module coupled to the body and capable of performing cleaning with water; a water tank capable of being withdrawn from the body, and storing water to be supplied to the cleaning module; and a light source positioned inside the body, and preset to allow emitted light to pass through the water tank and be then discharged to an outside of the body.

The cleaning module may be positioned below the body, and the water tank may be provided capable of being withdrawn from the body in a direction vertical to an upward-downward direction. The robot cleaner may further include an exterior water pipe positioned inside the water tank, forming a path along which water is discharged from the water tank, and protruding from an outer surface of the water tank in a direction in which the water tank is inserted.

The robot cleaner may further include: a cleaning module water supply pipe positioned in the body, and guiding the water discharged from the water tank to the cleaning module; and a water pipe coupler positioned at one end of the cleaning module water supply pipe, and connecting the exterior water pipe and the cleaning module water supply pipe when the water tank is inserted into the body.

The water pipe coupler may include at least one gasket which surrounds an outer circumferential surface of one end of the exterior water pipe when the water tank is inserted into the body. The exterior water pipe may be positioned closer to an upper side of the water tank than a lower side of the water tank. The robot cleaner may further include an exterior water pipe which is positioned inside the water tank, and has one end connected to the exterior water pipe and the other end disclosed closer to the lower side of the water tank than the upper side of the water tank.

The robot cleaner may further include: an air pipe positioned at one of the body and the water tank, and protruding toward the other of the body and the water tank; and an air pipe gasket positioned at the other of the body and the water tank, and surrounding an outer circumferential surface of one end of the air pipe with the water tank being inserted into the body.

The robot cleaner may further include a elastic force provider which provides an elastic force to the water tank in a direction in which the water tank is withdrawn. The elastic force provider may include: a moving bar capable of moving in a direction of movement of the water tank, and having one end in contact with the water tank; and an elastic element positioned to be deformed upon movement of the moving bar, and providing a constant elastic force, regardless of an amount of deformation of the elastic element.

The robot cleaner may include: a rack positioned on an outer surface of the water tank; one or more pinions positioned in the body, and engaged with the rack to rotate when the water tank is withdrawn; and a damper axially connected to any one of the one or more pinions, and providing a resistance force when a pinion connected to the damper rotates.

The embodiments of the present disclosure have one or more effects as follows. First, as a light source is preset to allow emitted light to pass through the water tank and be then discharged to the outside of the body, a user is able to easily check the amount of water stored in the water tank. Second, the water tank is able to slide horizontally, and thus residual water is less likely to remain in the water tank. Third, there is provided an exterior water pipe, which protrudes in a direction in which the water tank is inserted, and a water pipe coupler, which is connected to the exterior water pipe to supply water inside the body and which includes a gasket surrounding the outer circumferential surface of the exterior water pipe. Due to this configuration, a flow path can be sealed once the water tank is inserted into the body.

Fourth, the exterior water pipe is positioned in the upper side of the water tank, and there is an interior water pipe having one end connected to the exterior water pipe and the other end positioned in the lower side of the water tank. Due to this configuration, it is possible to prevent residual water caused by self-weight of water. Fifth, as one of the body and the water tank include an air pipe and the other thereof includes an air pipe gasket, sound pressure may be prevented from occurring inside the water tank when water stored in the water tamp is pumped using the robot cleaner, and it is possible to efficiently supply water to a cleaning module.

Sixth, as an elastic force provider is included to provide an elastic force to the water tank in a direction in which the water tank is withdrawn, it is possible to separate the water tank just by one touch without applying an additional force in the direction in which the water tank is withdrawn, and therefore, user convenience may improve. Seventh, a rack is positioned on an outer surface of the water tank, and one or more pinions are positioned in the body and engaged with the rack to rotate when the water tank is withdrawn, and a damper is axially connected to any one of the one or more pinions and provides a resistance force when a pinion connected to the damper rotates. Due to this configuration, the water tank is prevented from abruptly moving when being inserted or withdrawn, residual water is less likely to remain in the water tank, and a more comfortable feeling of operation is provided to a user.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternatives uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a body defining a recess;

a cleaning head coupled to the body, the cleaning head performing cleaning with water;

a water tank that is selectively received or withdrawn in the recess of the body and stores water to be supplied to the cleaning head; and a light source that is positioned inside the body and emits light that passes through the water tank and is discharged outside of the cleaner, wherein the cleaning head includes spinning mops that contact a floor when rotated and clean the floor based on receiving the water from the water tank when rotating.

2. The cleaner according to claim 1, wherein:

the water tank includes an exterior wall that is exposed outside of the body, and a region of the exterior wall is transparent, such that light from the light source passes through the region of the exterior wall and is then discharged outside of the body.

3. The cleaner according to claim 1, further comprising:

a connection detection sensor that detects whether the body and the water tank are connected, wherein the light source selectively emits light when the connection detection sensor detects that the body and the water tank are connected.

4. The cleaner according to claim 1, wherein the light source is positioned to face a surface of the water tank located in a direction in which the water tank is inserted.

5. The cleaner according to claim 1, wherein the water tank includes a water tank cover that covers a surface of the water tank facing outward of the body, and wherein the light emitted from the light source is discharged outside of the body through the water tank cover.

6. The cleaner according to claim 1, wherein the cleaning head is positioned below the body, and wherein the water tank is withdrawn from the body in a horizontal direction.

7. The cleaner according to claim 1, further comprising:

an exterior water pipe positioned inside the water tank, the exterior water pipe forming a path along which water is discharged from the water tank, and protruding from an outer surface of the water tank in a direction in which the water tank is inserted.

8. The cleaner according to claim 7, further comprising:

a cleaning head water supply pipe positioned in the body, the cleaning head water supply pipe guiding water from the water tank to the cleaning head; and a water pipe coupler positioned at one end of the cleaning head water supply pipe, the water pipe coupler connecting the exterior water pipe and the cleaning head water supply pipe when the water tank is inserted into the body.

9. The cleaner according to claim 8, wherein the water pipe coupler includes at least one gasket which surrounds an outer circumferential surface of an end of the exterior water pipe when the water tank is inserted into the body.

10. The cleaner according to claim 9, wherein the at least one gasket includes a plurality of gaskets arranged in the direction in which the water tank is inserted.

11. The cleaner according to claim 7, wherein the exterior water pipe is positioned closer to an upper side of the water tank than a lower side of the water tank, and wherein the cleaner further comprises an interior water pipe which is positioned inside the water tank, one end of the interior water pipe being connected to the exterior water pipe, and the other end of the interior water pipe being positioned closer to the lower side of the water tank than the upper side of the water tank.

12. The cleaner according to claim 1, further comprising:

an air pipe included in one of the body or the water tank and, and protruding toward another one of the body or the water tank; and an air pipe gasket positioned in the other one of the body or the water tank, the air pipe gasket surrounding an outer circumferential surface of one end of the air pipe when the water tank is inserted into the body.

13. The cleaner according to claim 1, further comprising:

a moving bar the selectively moves in a direction of movement of the water tank, the moving bar having one end contacting the water tank; and an elastic element that is deformed based on a movement of the moving bar to provide a consistent elastic force.

14. The cleaner according to claim 1, further comprising:

a rack positioned on an outer surface of the water tank;

one or more pinions positioned in the body, the one or more pinions engaging the rack to rotate when the water tank is moved; and a damper axially connected to one of the one or more pinions, the damper providing a resistance force when the connected to the damper rotates.

15. The cleaner according to claim 1, further comprising:

a latch protrusion that extends from a surface of the water tank; and a latch groove positioned in the body, the latch protrusion being received in the latch groove to couple the water tank to the body when the user pushes the water tank in a direction in which the water tank is inserted.

16. The cleaner according to claim 1, wherein the water tank includes a water tank cap that selectively opens and closes a water supply hole formed in an upper side of the water tank, and wherein the water tank cap includes:

a cap air hole;

a water tank cap lead that selectively opens and closes the cap air hole due to difference in air pressure between an inside and an outside of the water tank; and a cap elastic element providing an elastic force to the water tank cap lead.

17. The cleaner according to claim 1, wherein the spinning mops move the cleaner based on rotating and receiving the water from the water tank.

18. A cleaner comprising:

a body;

a cleaning head coupled to the body; and a water tank that is selectively received in the body and stores water to be supplied to the cleaning head, wherein:

the water tank includes an exterior wall, and a region of the exterior wall is transparent, and wherein the cleaning head includes spinning mops that contact a floor when rotated and clean the floor based on receiving the water from the water tank when rotating.

19. The cleaner of claim 18, further comprising:

a sensor that detects whether the water tank is received in the body; and a light source that is positioned inside the body and emits light that passes through the transparent region of the exterior wall when the sensor detects that the water tank is received in the body.

20. A cleaner comprising:

a body defining a recess;

a cleaning head coupled to the body, the cleaning head performing cleaning with water;

a water tank that is selectively received or withdrawn in the recess of the body and stores water to be supplied to the cleaning head; and a light source that is positioned inside the body and emits light that passes through the water tank and is discharged outside of the cleaner when the water tank is received in the recess, wherein the water tank includes a water tank cover that covers a surface of the water tank facing outward of the body, and wherein the light emitted from the light source is discharged outside of the body through the water tank cover.

* * * * *